US005561962A

United States Patent [19]

Everhard et al.

[11] Patent Number: 5,561,962

[45] Date of Patent: Oct. 8, 1996

[54] INSERT APPARATUS

[75] Inventors: Paul R. Everhard, Nicholasville; Alan L. Everhard, Lexington; Gregory J. Omvig, Lexington; Steven M. Swonke, Lexington, all of Ky.

[73] Assignee: Everhard Automation Controls, Inc., Lexington, Ky.

[21] Appl. No.: 461,685

[22] Filed: Jun. 5, 1995

[51] Int. Cl.[6] ..... B65B 5/04; B65B 43/18; B65B 43/30; B65B 43/36

[52] U.S. Cl. ..... 53/55; 53/496; 53/570; 53/381.6; 53/386.1

[58] Field of Search ..... 53/570, 571, 386.1, 53/381.6, 562, 453, 55, 67, 494, 496

[56] References Cited

U.S. PATENT DOCUMENTS

| | | | |
|---|---|---|---|
| 2,671,587 | 3/1954 | Vogt | 53/570 X |
| 3,503,179 | 3/1970 | Pierre | 53/386.1 X |
| 4,149,356 | 4/1979 | Palmer | 53/381.6 X |
| 4,365,458 | 12/1982 | Palmer et al. | 53/386.1 X |
| 4,548,826 | 10/1985 | Watkins | 53/386.1 X |
| 4,551,966 | 11/1985 | Aoyagi et al. | 53/386.1 X |
| 5,327,704 | 7/1994 | Hoekzema et al. | 53/570 X |

*Primary Examiner*—Horace M. Culver
*Attorney, Agent, or Firm*—Frank C. Leach, Jr.

[57] ABSTRACT

A compact disc (CD) is inserted into a sleeve as the sleeve is continuously advanced past a load position at which the CD is removed from a vertical spindle by a pivotally mounted lift arm and inserted into an open edge of the sleeve with the arm moving at the same linear speed as the sleeve. Each of the sleeves is supplied from a magazine by timing belts to a conveyor belt. The pivotally mounted arm picks up the CD through an arcuate groove on its bottom surface having a vacuum applied thereto. The arm also has a pressurized air hole for insuring that the open edge of the sleeve is sufficiently open to receive the CD. After the CD is inserted into the sleeve, two linearly spaced push-in units complete full insertion of the CD into the sleeve. If the sleeve does not have a CD inserted, it is automatically removed from the conveyor belt after passing the first push-in unit. The sleeve is held on the conveyor belt by a vacuum and is held by the vacuum against a straight surface of a guide edge. The linear speed of the conveyor belt can be changed as desired by a user. The spindle is mounted on a turntable along with a plurality of other spindles. Each spindle may have a stack of the CDs thereon. If the spindle does not have a stack of CDs thereon, it is advanced past the supply position.

37 Claims, 24 Drawing Sheets

| FIG. 1A | FIG. 1B | FIG. 1C | FIG. 1D |
|---|---|---|---|

16
16A
16B
15
18
19
66
67
68
69
71
72
74
106
107
107'
108
109
110
111
112
113
114
115
116
117
118
119
120
121
122
123
127

INSERT APPARATUS

This invention relates to an insert apparatus for inserting an element into a container, and more particularly, to an insert apparatus for inserting an element into a container when the container is being continuously advanced in a linear direction.

Elements such as compact discs (CDs), for example, are inserted in containers, known as sleeves, having at least one edge open through which the element is inserted. Other types of elements such as musical records and computer disks having software thereon, for example, also are packaged in sleeves. The insertion of the elements into containers has been accomplished through manual insertion of each of the elements through the open or slit edge of one of the containers. This is a relatively expensive packaging cost because of the manual labor.

A CD may be grasped only at an annular area around its center opening or at its edge. Otherwise, the information on the CD may be lost. This requires very careful handling when manually inserting the CD into the sleeve so as to further increase the packaging cost.

The insert apparatus of the present invention eliminates the relatively high labor costs for inserting CDs into sleeves. This is accomplished through automatically inserting each of the CDs into a sleeve through an open or slit edge.

The insert apparatus of the present invention handles the CDs when they are the elements to be inserted into the sleeves without any loss of information on the CD. This is accomplished through picking up the CD through applying a vacuum only to an annular area around its center opening.

The insert apparatus of the present invention is capable of changing the linear feed rate of the sleeves having the CDs automatically inserted therein during the travel of the sleeve. Thus, the insert apparatus of the present invention is capable of operating at various desired feed rates so as to be useful with other devices having fixed linear speeds to which the sleeves are transferred from the insert apparatus of the present invention.

The insert apparatus of the present invention continuously feeds the sleeves at a selected feed rate past a load position at which each of the CDs is inserted into one of the sleeves. When the CD is inserted into the sleeve, the CD is moving at the same linear rate as the sleeve. Controls insure that the CD enters the slit or open edge of the sleeve at the proper time since the sleeve can realistically be only slightly larger than the CD. Otherwise, the CD will move around within the sleeve and can be damaged.

An object of this invention is to automatically insert an element into a container.

Another object of this invention is to insert a compact disc into a sleeve.

A further object of this invention is to automatically insert an element having maximum dimensions only slightly smaller than maximum dimensions of the interior of the container so that the element has a relatively tight fit within the container after insertion is completed.

Other objects of this invention will be readily perceived from the following description, claims, and drawings.

This invention relates to an apparatus for inserting an element into a container having at least one edge open including continuously linear advancing means for continuously advancing a container having at least one edge open from a first position to a second position in a linear direction to enable an element to be inserted into the container. During its linear advancement by the continuously linear advancing means, the container is maintained in a desired orientation by maintaining means. An element is inserted into the container by inserting means during linear advancement of the container by the continuously linear advancing means at a first intermediate position between the first and second positions. The at least one open edge of the container is held sufficiently open by holding means when the inserting means is effective to receive the element inserted by the inserting means.

The attached drawings illustrate a preferred embodiment of the invention, in which.

Figures 1, 1A:
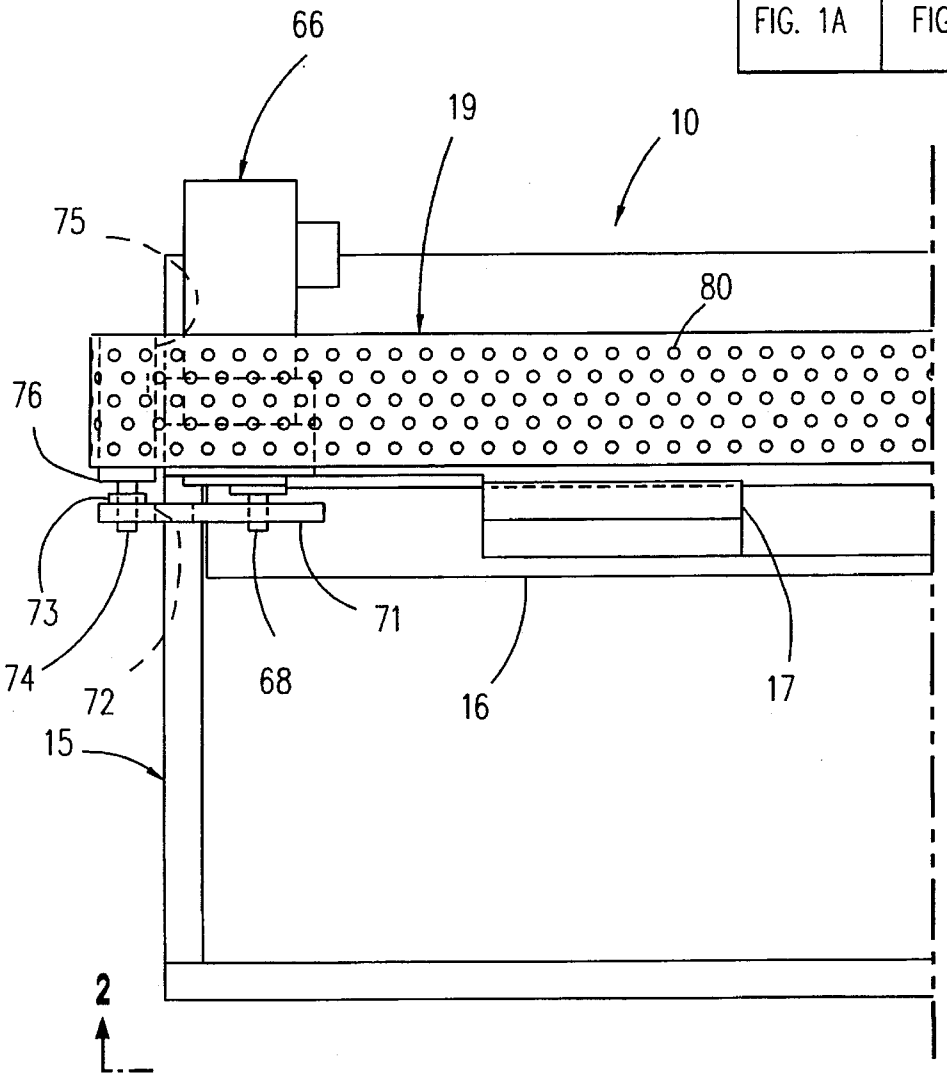
FIG. 1 is a block diagram showing the relation of FIGS. 1A, 1B, 1C, and 1D.
FIG. 1A is an enlarged fragmentary top plan view of a portion of the insert apparatus of the present invention including the drive motor arrangement for driving the conveyor with parts omitted for clarity purposes.
Figure 1B:
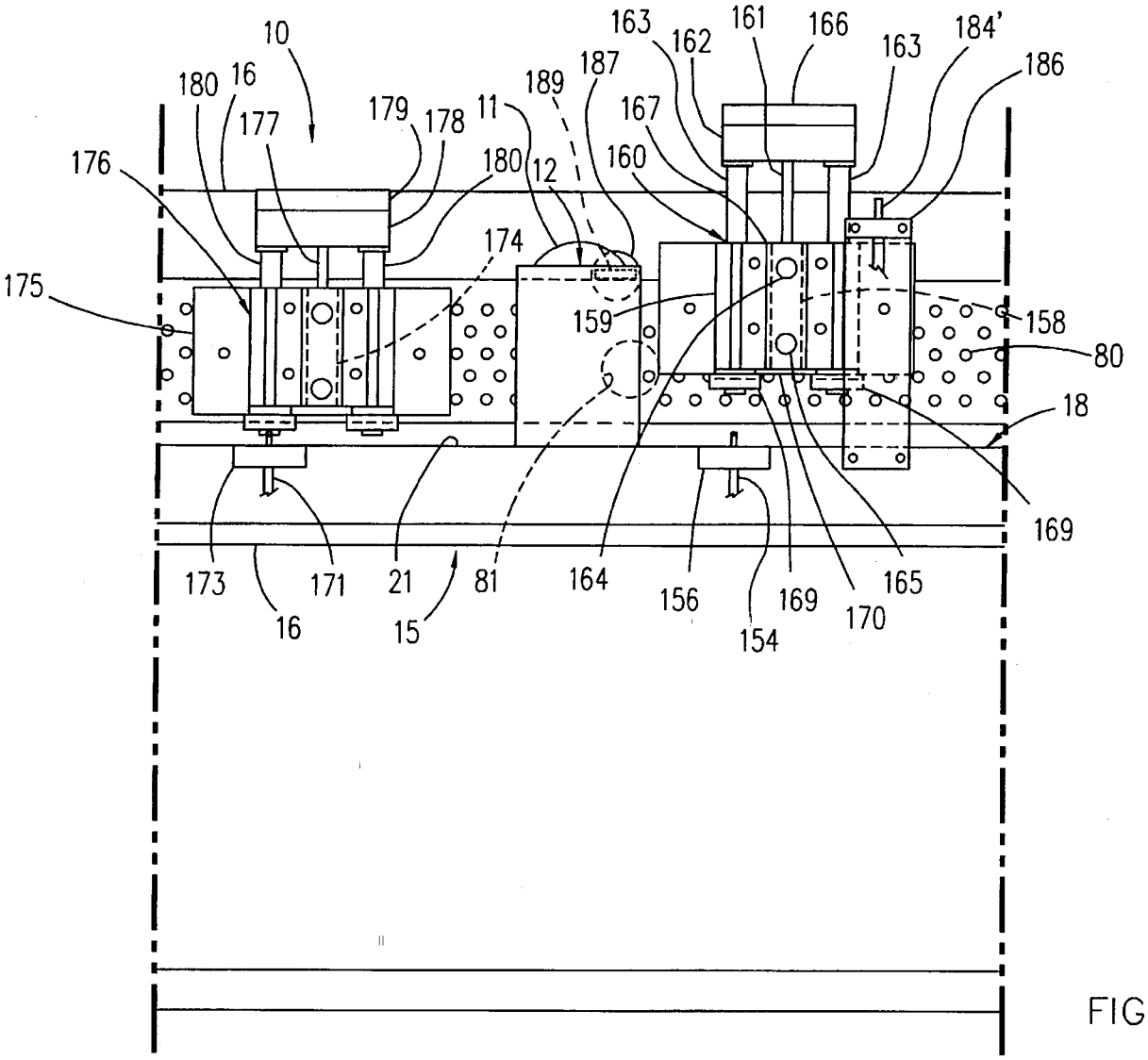
FIG. 1B is an enlarged fragmentary top plan view of another portion of the insert apparatus of the present invention including push-in units with an ejector therebetween with parts omitted for clarity purposes.
Figure 1C:
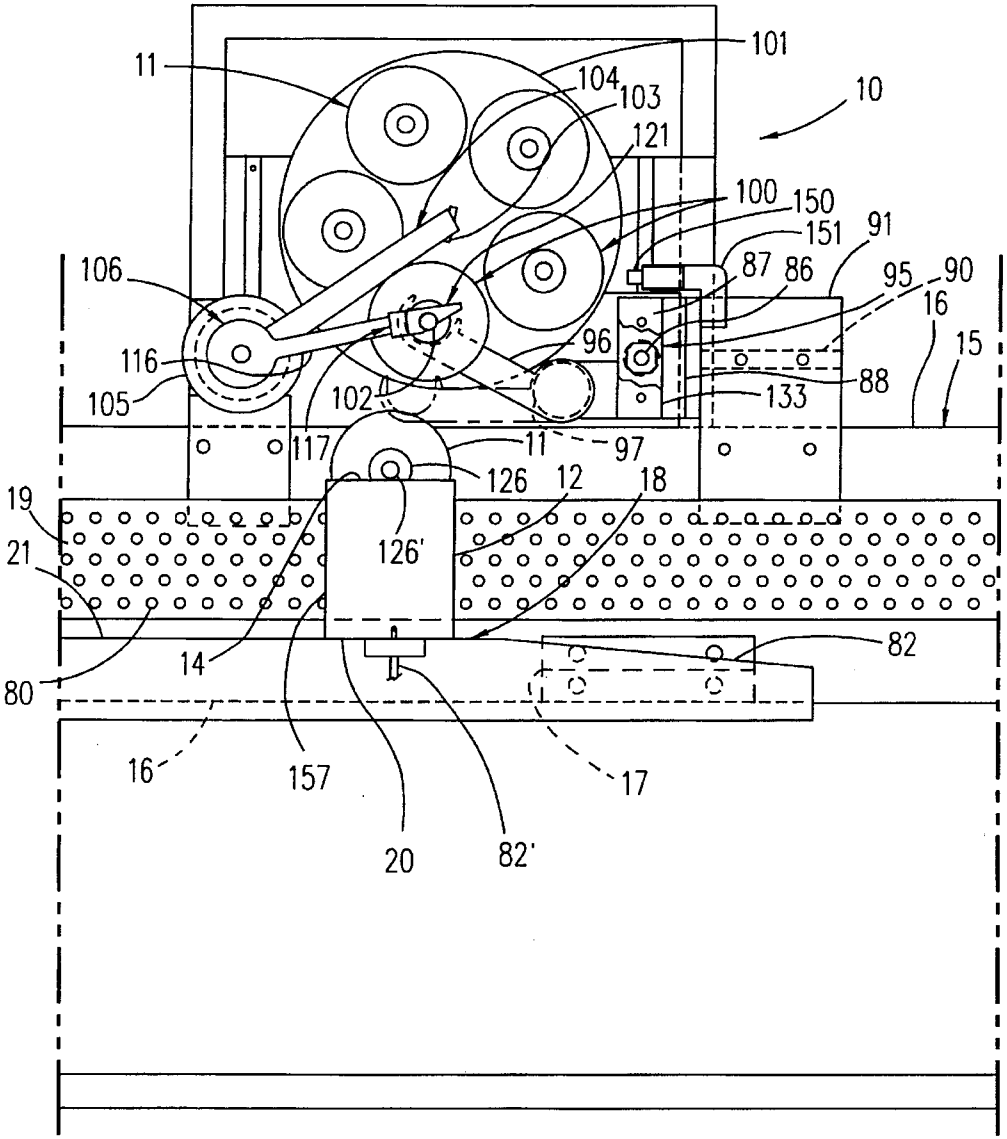
FIG. 1C is an enlarged fragmentary top plan view of still another portion of the insert apparatus of the present invention including an insert mechanism with parts omitted for clarity purposes.

Referring to the drawings and particularly FIG. 1C, there is shown an insert apparatus 10 for inserting an element such as a compact disc (CD) 11, for example, into a container such as a sleeve 12 having at least an edge 14 open, for example, through which the CD 11 is inserted. The apparatus 10 includes a support frame 15 having a substantially horizontal upper, main support plate 16 (see FIG. 2), which is supported by a plurality of horizontal square tubes 16A. The horizontal square tubes 16A extend perpendicular to each other and are supported on the upper ends of vertical square tubes 16B.

A pair of support brackets 17 is mounted on the upper plate 16 and extends upwardly therefrom. The support brackets 17 support a guide edge or rail 18 for guiding the sleeve 12 (see FIG. 1C) during its advancement from right to left, as viewed in FIG. 1C, by a conveyor belt 19 of a vacuum conveyor 19' (see FIG. 6).

The sleeve 12 (see FIG. 1C) is guided by its edge 20 sliding along a straight surface 21 of the guide edge 18. One suitable example of the vacuum conveyor 19' (see FIG. 6) is sold by Dorner Mfg. Corp., Hartland, Wis. as a Model 4100 Series conveyor.

Figure 5:
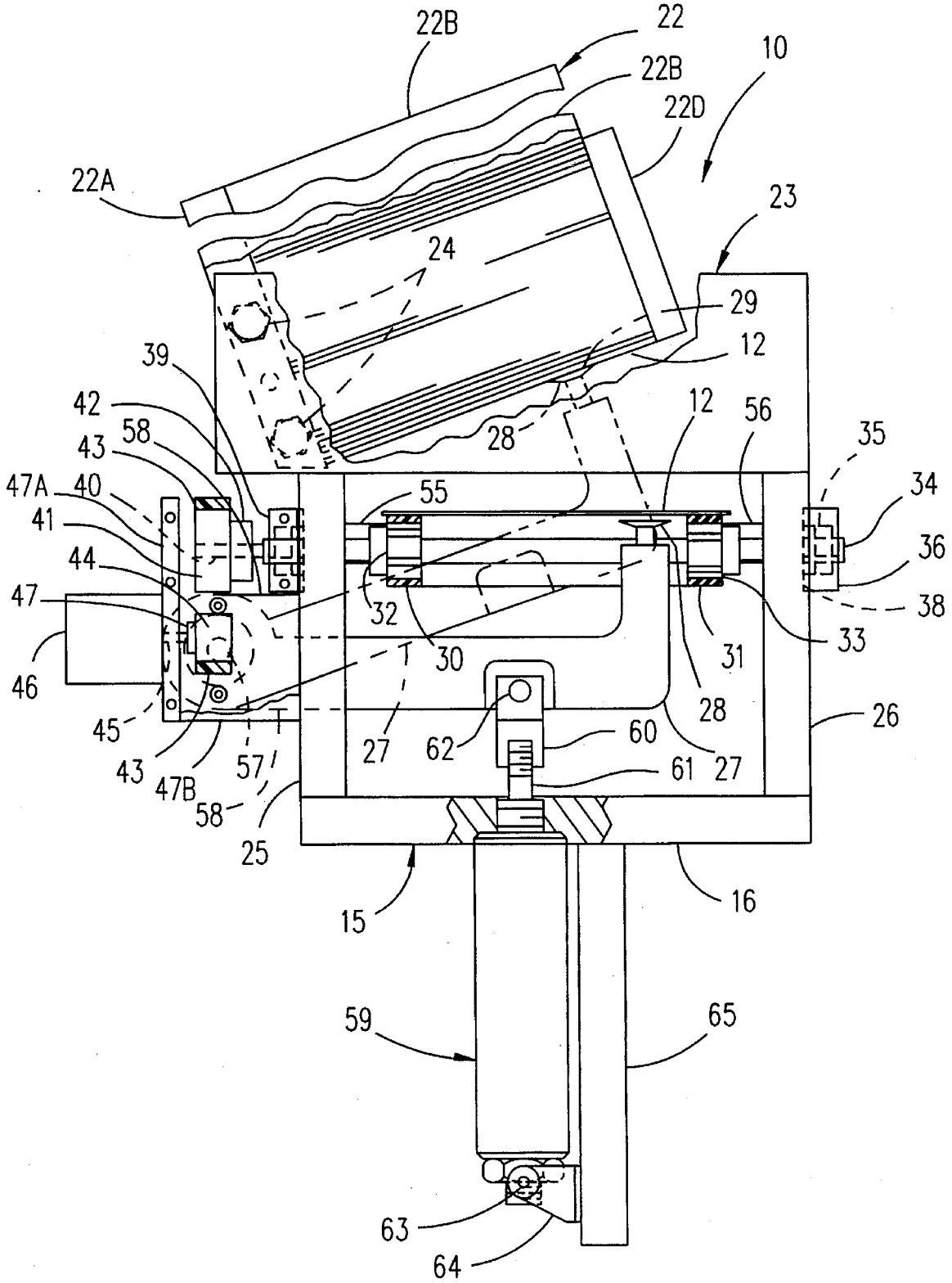
FIG. 5 is an end elevational view of a portion of the insert apparatus of the present invention and taken along line 5—5 of FIG. 1D.

The sleeves 12 are stored in a magazine 22 (see FIG. 5) in a stack. The magazine 22 is supported at an angle to the vertical by the support frame 15. This positions each of the sleeves 12 at an angle to the horizontal.

The magazine 22 includes an end plate 22A (see FIG. 2) and two parallel side plates 22B and 22C extending the same horizontal distance and the same vertical distance as the end plate 22A. Each of the side plates 22B and 22C has an end plate 22D (see FIG. 5) at its end remote from the end plate 22A and extending upwardly for a shorter distance than the side plates 22B and 22C (see FIG. 2). The end plates 22D (see FIG. 5) extend inwardly toward each other but are spaced from each other to provide a vertical slot (not shown) to enable loading of the sleeves 12 in the magazine 22.

The magazine 22 is mounted at an angle to the vertical through being attached to a substantially vertical support plate 23 by bolts 24. The plate 23 is attached to the top of each of a pair of substantially vertical support plates 25 and 26, which are supported by the upper, main support plate 16 of the support frame 15 at its upper surface.

Accordingly, when a pivotally mounted arm 27 is moved to its sleeve pick-up position (phantom line position in FIG. 5), a vacuum cup 28 on one end of the pivotally mounted arm 27 has its end surface 29 at the same angle to the horizontal as the sleeve 12. Thus, the end surface 29 of the vacuum cup 28 abuts the lowermost of the sleeves 12 in the magazine 22 to have good contact with the lowermost sleeve 12 to enable the sleeve 12 to be removed from the magazine 22 and retained on the vacuum cup 28 by a vacuum.

As the arm 27 is pivoted clockwise (as viewed in FIG. 5), the sleeve 12, which is retained on the vacuum cup 28, engages the upper portion of each of a pair of timing belts 30 and 31 to rest thereon. The timing belts 30 and 31 pass around a pair of timing pulleys 32 and 33, respectively.

The timing pulleys 32 and 33 are supported on a substantially horizontal shaft 34. The shaft 34 extends through the substantially vertical parallel plates 25 and 26 and is rotatably supported thereby.

One end of the shaft 34 extends through the vertical plate 26 and has a bearing 35 disposed within a bearing mount 36 to be rotatably supported thereby. The bearing 35 is retained within the bearing mount 36 by suitable means such as a snap ring (not shown), for example. A portion of the bearing mount 36 is disposed within a recess 38 in the vertical plate 26. The bearing mount 36 is adjustable within the recess 38 in the vertical plate 26.

The shaft 34 has its other end rotatably supported within a bearing mount 39, which is adjustably supported on the vertical plate 25 in the same manner as the bearing mount 36 is adjustably supported on the vertical plate 26. This end of the shaft 34 has a portion 40 with a smaller diameter on which is mounted a timing pulley 41 through its hub 42. A timing belt 43 passes around the timing pulley 41 and a timing pulley 44, which is mounted on a shaft 45 of an incremental encoder 46 through its hub 47.

Figure 1D:
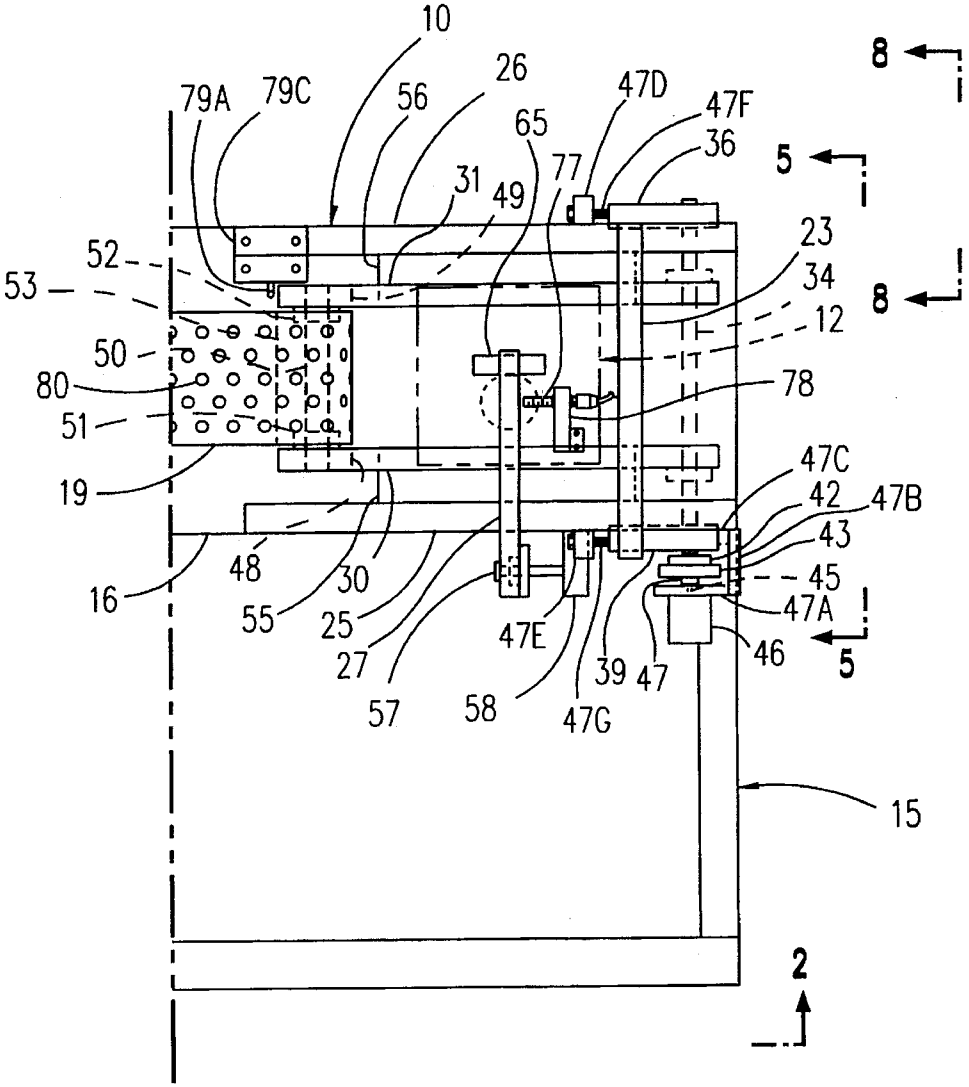
FIG. 1D is an enlarged fragmentary top plan view of yet another portion of the insert apparatus of the present invention including an arrangement for loading a sleeve on a conveyor with parts omitted for clarity purposes.

The incremental encoder 46 is supported on a plate 47A (see FIG. 1D), which is connected to one end of a plate 47B disposed perpendicular thereto. The plate 47B has its other end attached to a spacer 47C, which is secured to the bearing mount 39. This enables the incremental encoder 46 to move with the bearing mount 39 when the bearing mount 39 is adjusted. The bearing mounts 36 and 39 are adjusted by turning bolts 47F and 47G, respectively, disposed within blocks 47D and 47E, respectively, on the vertical plates 26 and 25, respectively, to tighten the timing belts 31 and 30, respectively, through moving the shaft 34 in one direction and to loosen the timing belts 31 and 30 through moving the shaft 34 in the opposite direction.

The timing belts 30 and 31 also pass around timing pulleys 48 and 49, respectively. The timing pulleys 48 and 49 are mounted on a round end portion of a substantially horizontal shaft 50 through hubs 51 and 52, respectively.

The shaft 50 has a hexagonal cross sectional portion for disposition within a hexagonal portion of a passage in a hollow knurled roller or spindle 53. The roller 53 is rotatably supported by a support 54 (see FIG. 6) of the vacuum conveyor 19' through needle bearings 54A supported on walls 54B and 54C of the support 54. The shaft 50 (see FIG. 1D) has its round end portion exterior of the wall 54C (see FIG. 6) of the support 54. The roller 53 has the conveyor belt 19 pass therearound.

The vertical plates 25 (see FIG. 5) and 26 support belt supports 55 and 56, respectively, for supporting the upper spans or portions of the timing belts 30 and 31, respectively. The belt supports 55 and 56 extend towards each other from the vertical plates 25 and 26, respectively, and are positioned beneath the upper spans or portions of the timing belts 30 and 31, respectively.

The arm 27 is pivotally mounted on a shoulder bolt 57 (see FIG. 1D), which is supported by a bracket 58. The bracket 58 is supported on the outer surface of the vertical plate 25.

The arm 27 (see FIG. 5) is moved between its sleeve pick-up position (phantom line position of FIG. 5) and its rest or home position (solid line position of FIG. 5) by an air cylinder 59. The air cylinder 59 has a clevis 60 attached to its piston rod 61 and to a pivot pin 62 on the arm 27.

The lower end of the air cylinder 59 is pivotally attached by a pin 63 to a bracket 64, which is secured to a substantially vertical plate 65 of the support frame 15. The substantially vertical plate 65 is secured to the bottom surface of the upper, main support plate 16 of the support frame 15.

Thus, each time that the piston rod 61 is extended from the air cylinder 59 by pressurized air being supplied to the bottom of its piston, the pivotally mounted arm 27 is moved to its sleeve pick-up position to pick up the lowermost of the sleeves 12 within the magazine 22 through a vacuum being applied to the sleeve 12 by the vacuum cup 28. When the supply of pressurized air to the air cylinder 59 is reversed, the sleeve 12 is deposited on the timing belts 30 and 31 prior to the pivotally mounted arm 27 reaching its rest or lowermost position.

Figures 7, 9:
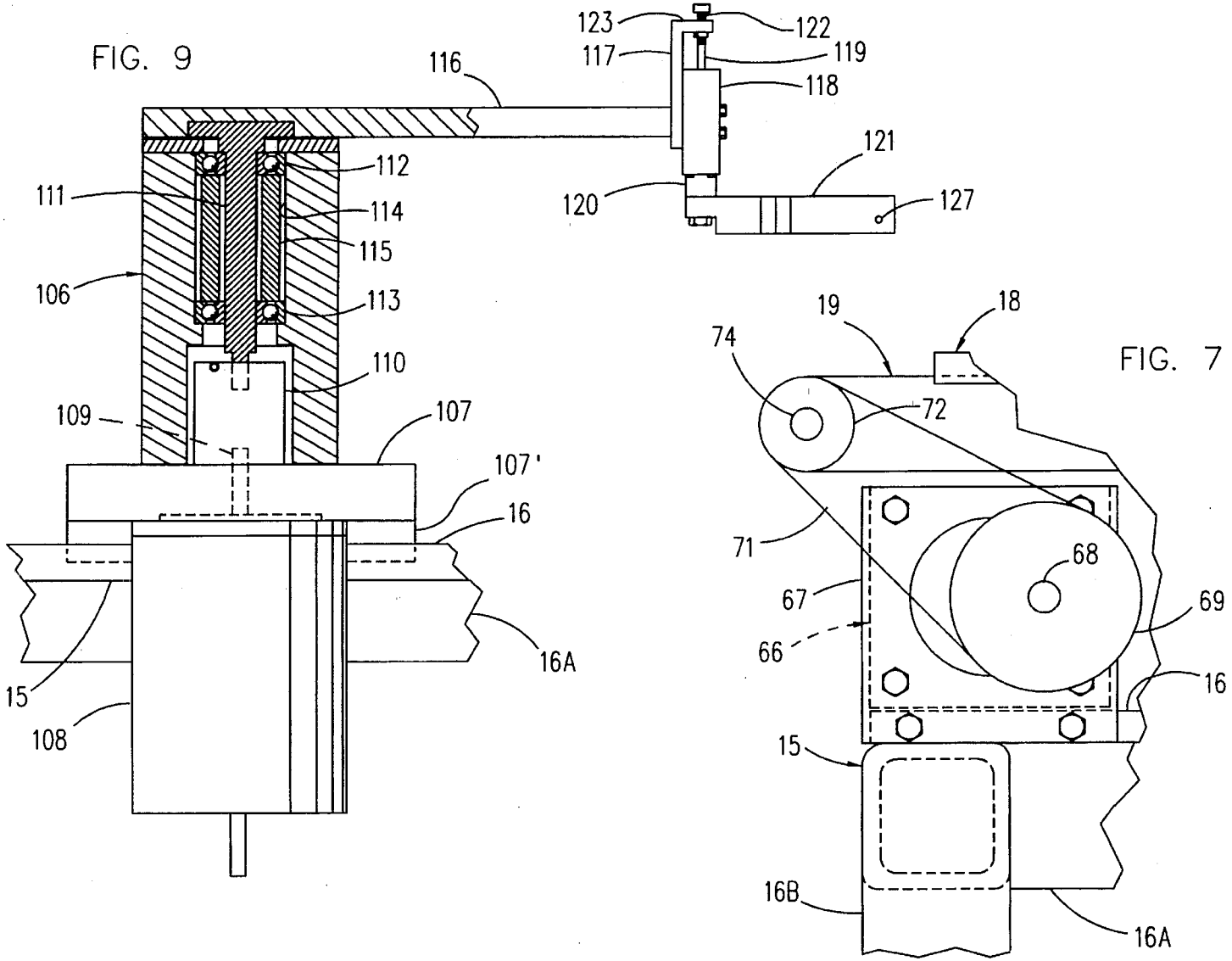
FIG. 7 is an enlarged fragmentary side elevational view of a portion of the insert apparatus of the present invention and showing a driving arrangement for the vacuum conveyor.
FIG. 9 is an enlarged fragmentary side elevational view, partly in section, of a portion of the insert apparatus of FIG. 2 and showing a driving arrangement for a pick-up arm.

The timing belts 30 and 31 are continuously driven from a gear motor 66 (see FIG. 1A). One suitable example of the gear motor 66 is a gear motor sold by Grainger Division of W. W. Grainger, Inc., Lexington, Ky. as Model 6Z916-5. The gear motor 66 is mounted on a support bracket 67 (see FIG. 7), which is supported by the upper plate 16 of the support frame 15.

The gear motor 66 drives a shaft 68 supporting a timing pulley 69. A timing belt 71 passes around the timing pulley 69 and a timing pulley 72, which is mounted by its hub 73 (see FIG. 1A) on a shaft 74.

The shaft 74 has a hollow knurled roller or spindle 75, which is the same as the hollow roller 53 (see FIG. 6), mounted thereon and around which the conveyor belt 19 passes. The shaft 74 (see FIG. 1A) has a hexagonal portion extending through a hexagonal portion of a passage in the hollow roller 75 and a round end portion on which the timing pulley 72 and the hub 73 are mounted. The round end portion of the shaft 74 extends through a bearing 76 supported by the wall 54B (see FIG. 6) of the support 54 of the vacuum conveyor 19'. The shaft 74 (see FIG. 1A) and the bearing 76 are part of an adapter assembly sold by Dorner Mfg. Corp., Hartland, Wis. as Model No. 43-38-03.

The shaft 74 transfers the drive from the gear motor 66 to the conveyor belt 19 because of the shaft 74 having its hexagonal portion snugly fitting within the hexagonal portion of the passage in the hollow roller 75. The conveyor belt 19 transfers its motion through the hollow roller 53 (see FIG. 1D) to the shaft 50 to continuously and positively drive the timing belts 30 and 31 from the gear motor 66 (see FIG. 1A) because of the shaft 50 (see FIG. 1D) having its hexagonal portion snugly fitting within the hexagonal portion of the passage in the hollow roller 53 (see FIG. 6).

Figure 13:
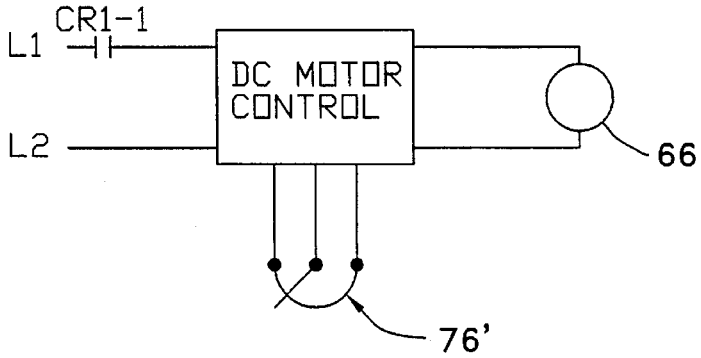
FIG. 13 is a schematic electrical diagram of a circuit for a motor used to drive the conveyor belt of the insert apparatus of the present invention.
Figure 15:
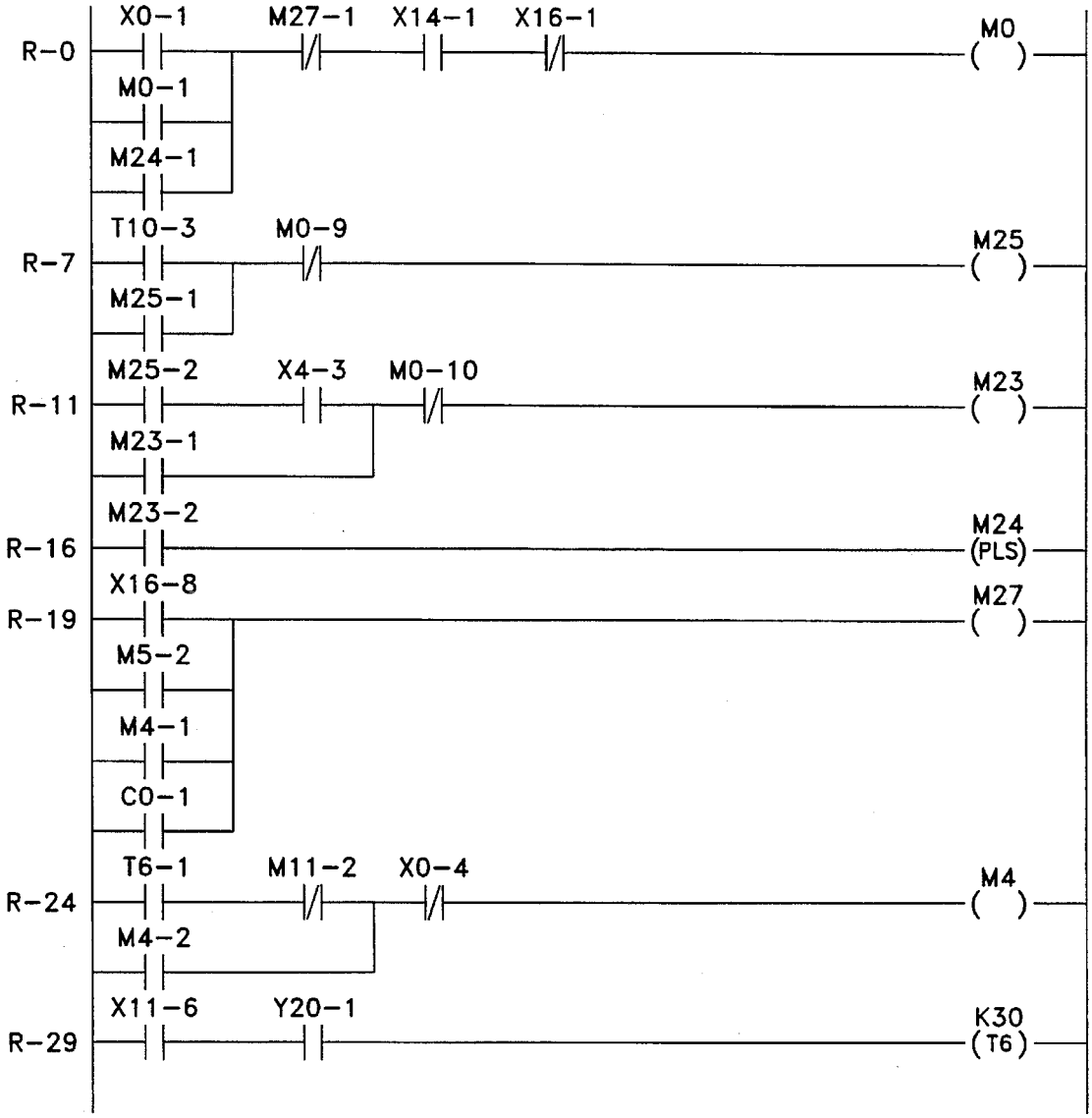
FIGS. 15–21 are a ladder logic diagram of signals produced by a programmable controller for controlling operation of the insert apparatus of the present invention.
Figure 16:
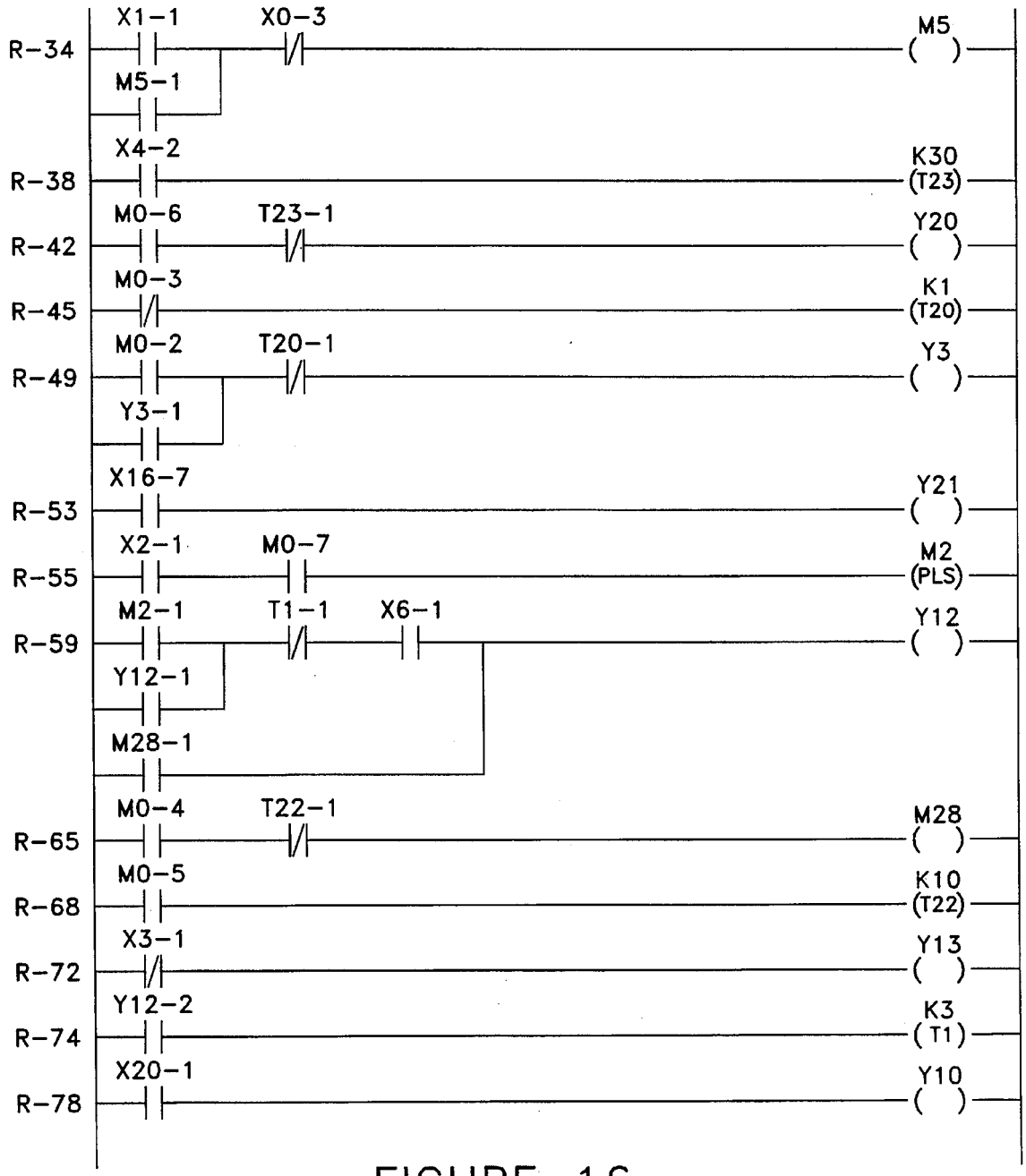
Figure 17:
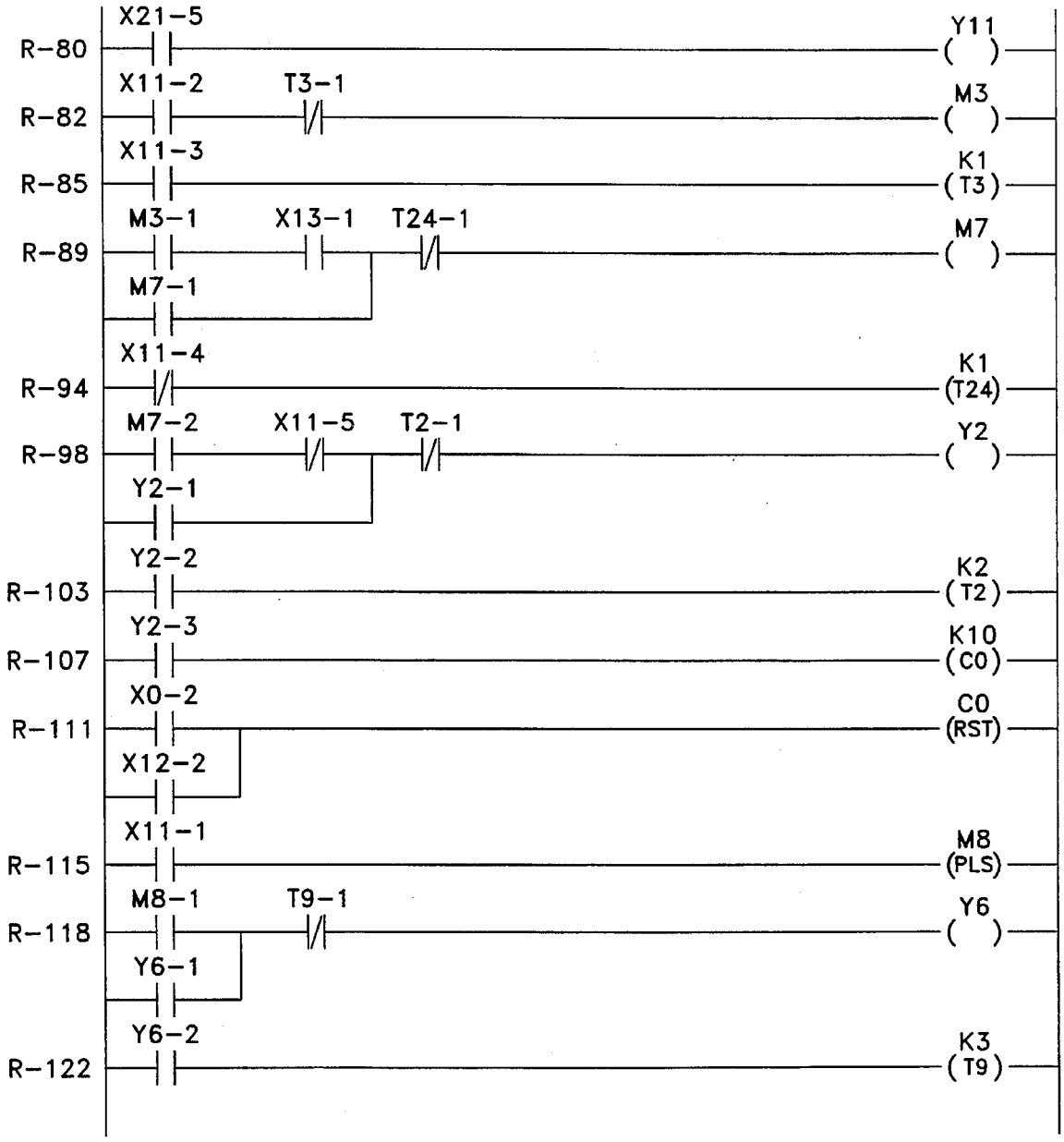
Figure 18:
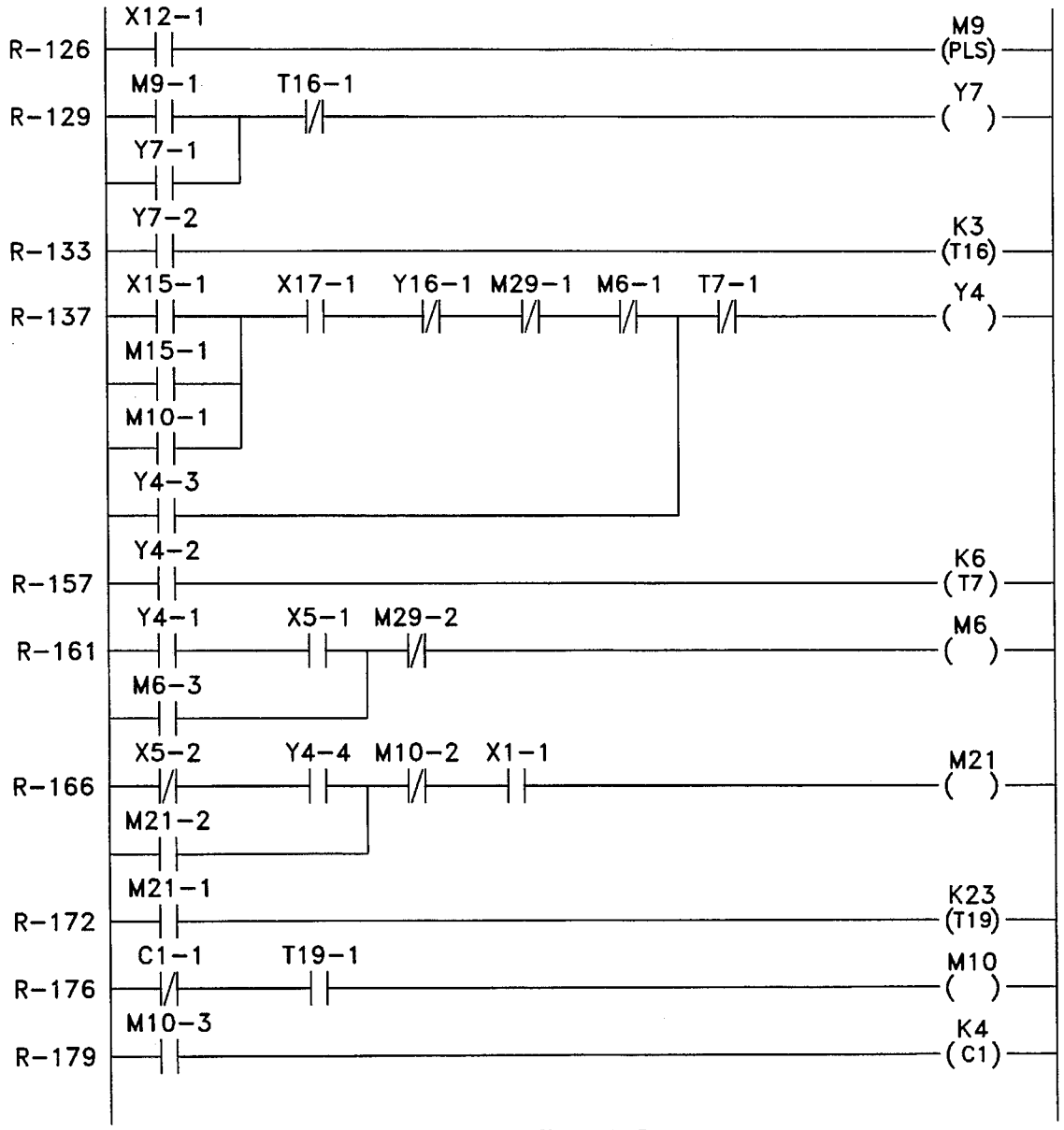
Figure 19:
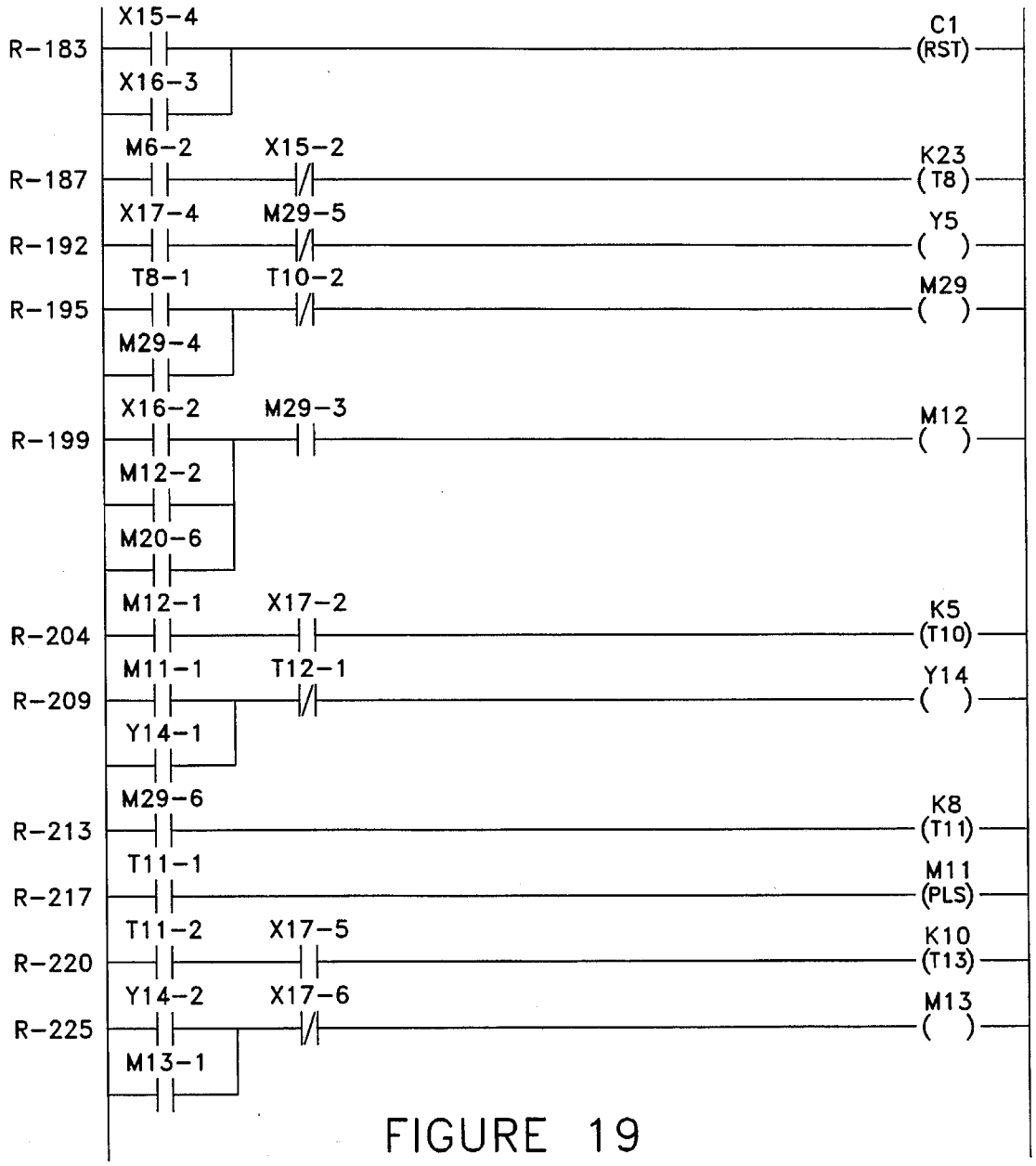
Figure 20:
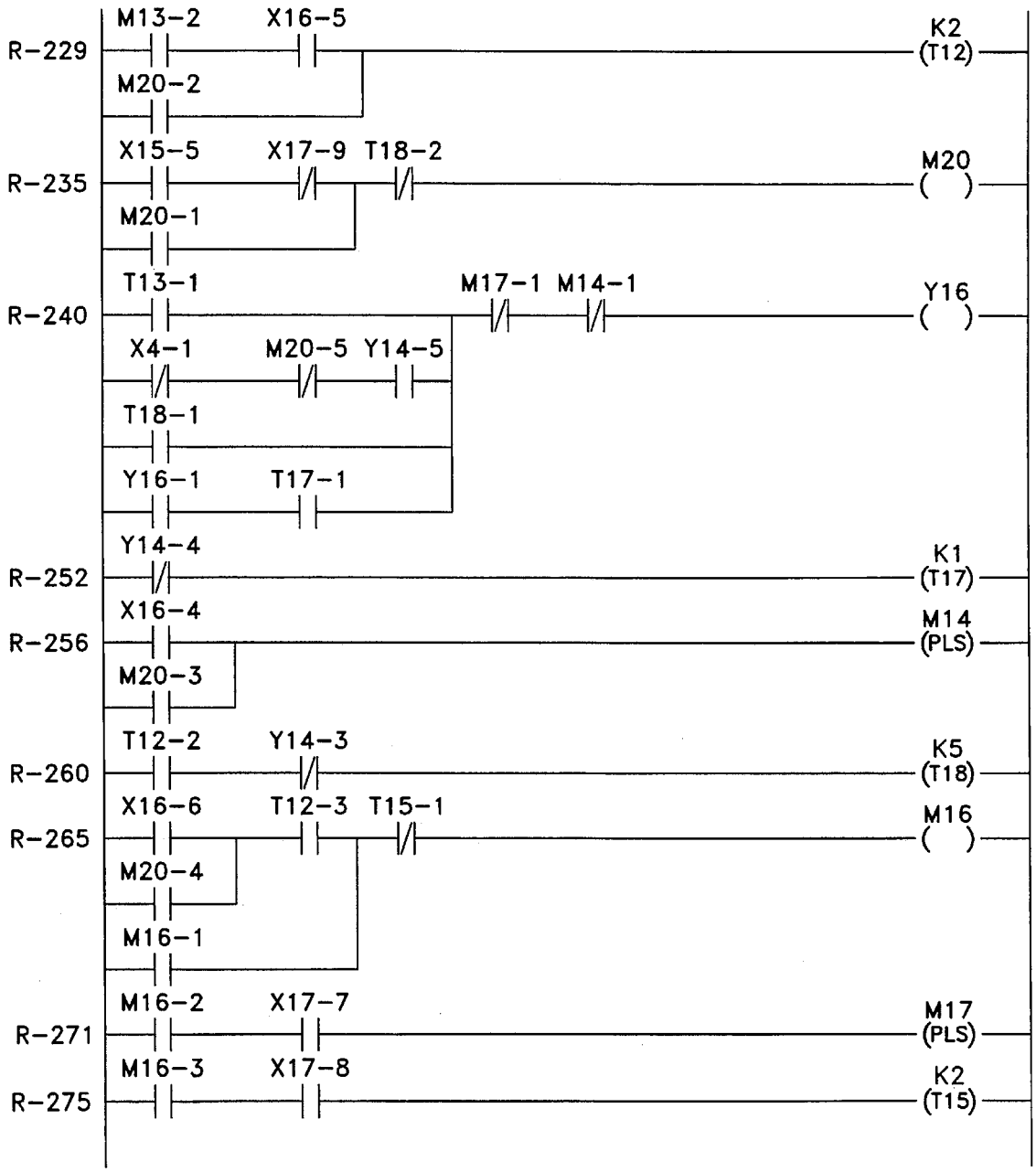
Figure 21:
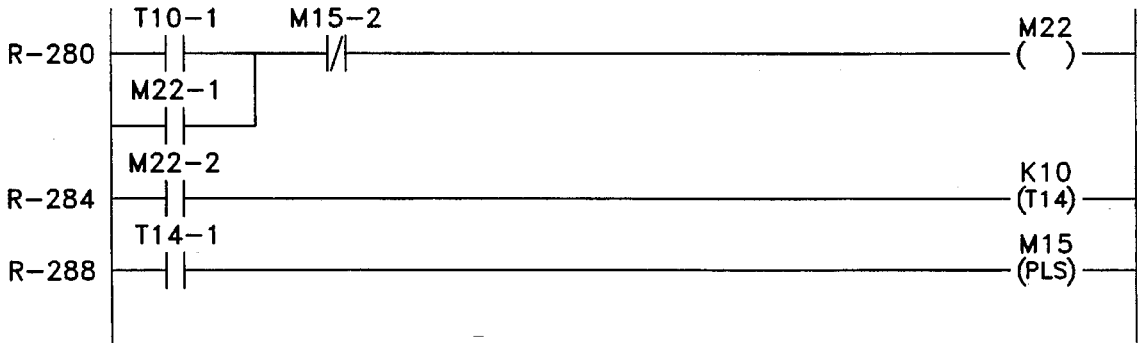

The speed of the gear motor 66 (see FIG. 1A) is controlled by a manually controlled potentiometer 76' (see FIG. 13). Thus, the speed of the conveyor belt 19 (see FIG. 1D) and the timing belts 30 and 31 may be changed at any time.

When the pivotally mounted arm 27 (see FIG. 5) has returned to its rest or home position (solid line position of FIG. 5), a proximity switch 77 (see FIG. 1D), which is supported on a bracket 78 extending upwardly from the upper plate 16 of the support frame 15, senses the presence of the pivot pin 62 (see FIG. 5) of the clevis 60 when the clevis 60 is disposed so that the sleeve 12 is horizontal. This is prior to the pivotally mounted arm 27 reaching its rest or home position but is when the sleeve 12 rests on the timing belts 30 and 31. One suitable example of the proximity switch 77 is a proximity switch sold by Ballaff Inc., Florence, Ky. as Model No. 210-BES-516-378-54C.

When the pivot pin 62 of the clevis 60 is sensed by the proximity switch 77 (see FIG. 1D), the vacuum at the vacuum cup 28 (see FIG. 5) is turned off. The pivotally mounted arm 27 then returns to its rest position at which the vacuum cup 28 is beneath the sleeve 12 and spaced therefrom.

With the vacuum removed from the vacuum cup 28, the sleeve 12 is free to be moved by the continuously moving timing belts 30 and 31. The sleeve 12 is advanced by the timing belts 30 and 31 to the conveyor belt 19 (see FIG. 1D), which is moving linearly at the same speed as the timing belts 30 and 31.

When the sleeve 12 reaches the conveyor belt 19, an infrared sensor 79 (see FIG. 12) has its fiberoptic cable 79A disposed so that the sensor 79 senses the presence of the sleeve 12 (see FIG. 1D) being advanced onto the conveyor belt 19 from the timing belts 30 and 31. This sensing of the sleeve 12 by the sensor 79 (see FIG. 12), which is mounted on a vertical plate 79B supported by the support frame 15 (see FIG. 1D), indicates that the sleeve 12 (see FIG. 5) has cleared the magazine 22. The fiberoptic cable 79A (see FIG. 1D) is supported by the vertical plate 26 through a support plate 79C.

The sensor 79 (see FIG. 12) produces a signal to cause the pivotally mounted arm 27 (see FIG. 5) to be raised upwardly by applying pressurized air to the air cylinder 59 to extend the piston rod 61 therefrom. At the same time, a vacuum is applied to the vacuum cup 28 on the end of the pivotally mounted arm 27.

The conveyor belt 19 (see FIG. 1C) has holes 80 throughout to enable a vacuum within the interior of the conveyor belt 19 to be applied to the sleeve 12 to retain the sleeve 12 on the conveyor belt 19. The vacuum is applied to the interior of the support 54 (see FIG. 6) of the conveyor 19' through an opening 81 (see FIG. 1B) in a base 81A (see FIG. 6) of the support 54 of the vacuum conveyor 19'.

The support 54 of the vacuum conveyor 19' has a belt support 81B supporting the upper span or portion of the conveyor belt 19. The belt support 81B, which extends between the vertical walls 54B and 54C, has two longitudinal slots 81C extending therethrough and throughout most of its length to enable the vacuum to be applied to the upper span or portion of the conveyor belt 19, which supports the sleeve 12 (see FIG. 1C).

As the sleeve 12 is initially advanced by the conveyor belt 19, the guide edge 18 has an angled entrance surface 82. This insures that the sleeve 12 is positioned with the edge 20 of the sleeve 12 engaging the straight surface 21 of the guide edge 18. The vacuum applied to the sleeve 12 through the holes 80 in the conveyor belt 19 applies a vacuum to the sleeve 12 to maintain the sleeve 12 in a desired orientation.

The insert apparatus 10 includes a stepper motor 85 (see FIG. 4), which is supported by a substantially horizontal plate 85' of the support frame 15, to rotate a lead screw 86. One suitable example of the stepper motor 85 is a stepper motor sold by Compumotor Division of Parker-Hannifin Corporation, Rohnert Park, Calif. as Model 088 PK-3-83-93-PK3. One suitable example of the lead screw 86 is a lead screw sold by McMaster-Carr Supply Company as Model No. 5966K55.

The lead screw 86 has its upper end rotatably supported in a substantially horizontal upper plate 87 at the upper end of a substantially vertical plate 88. The substantially vertical plate 88 also has a substantially horizontal lower plate 89 rotatably supporting the lead screw 86 adjacent its bottom end.

The substantially vertical plate 88 is secured to a mounting plate 90, which is secured to the bottom surface of a substantially horizontal support plate 91 (see FIG. 1C). The substantially horizontal support plate 91 is attached to the upper surface of the upper plate 16 (see FIG. 4) of the support frame 15.

The lead screw 86 is connected through a coupling 92 to a shaft 93 of the stepper motor 85. One suitable example of the coupling 92 is a coupling sold by SDP Division of Designatronics Inc., New Hyde Park, N.Y. as Model No. A5Z15-333312.

Figure 8:
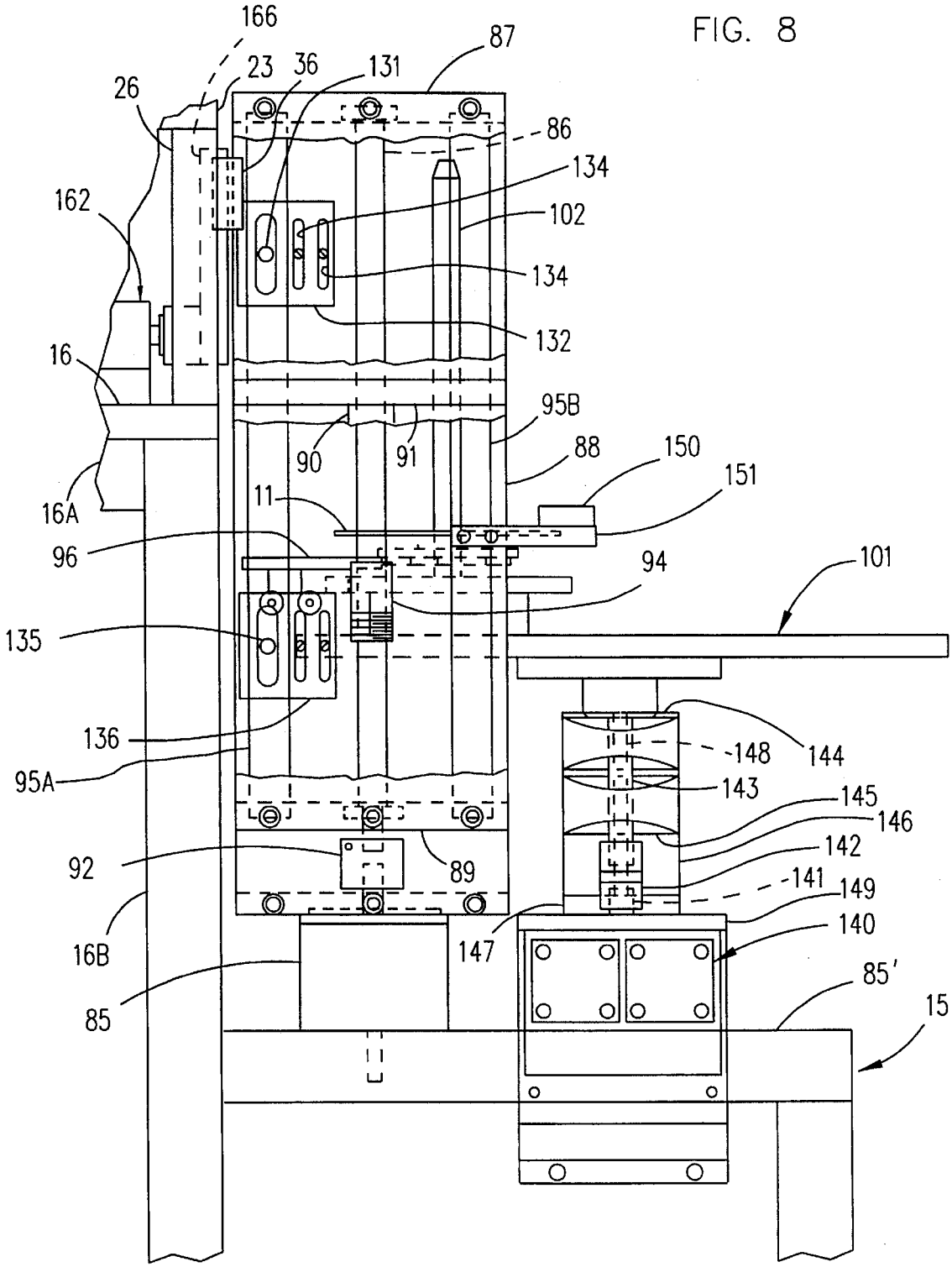
FIG. 8 is an enlarged fragmentary end elevational view of a portion of the insert apparatus of the present invention and taken along line 8—8 of FIG. 1D.

The lead screw 86 is connected through a ball nut 94 to a plate 95, which has the nut 94 fixed thereto. The plate 95 is slidably mounted on a pair of substantially parallel guide rods 95A (see FIG. 8) and 95B. The guide rods 95A and 95B extend between the substantially plates 87 and 90.

The plate 95 (see FIG. 4) has a lift arm 96 connected thereto through a rotary pneumatic actuator 97. One suitable example of the ball nut 94 (see FIG. 3) is a ball nut sold by McMaster-Carr Supply Company as Model No. 5966K16.

The ball nut 94 has a lower portion of its outer surface 98 threaded for threading into a threaded hole 99 in the plate 95. This transfers the rotary motion of the lead screw 86 into linear motion of the plate 95 in a vertical direction.

The stepper motor 85 (see FIG. 2) causes a stack 100 of the CDs 11 (see FIG. 1C) to be lifted each time that the stepper motor 85 (see FIG. 2) is energized. This raises the uppermost of the CDs 11 (see FIG. 1C) in the stack 100 to a predetermined position.

As shown in FIG. 1C, the stack 100 of the CDs 11 is one of a plurality of the stacks 100 of the CDs 11 supported on a turntable 101. Each of the stacks 100 of the CDs 11 is supported on a spindle 102 extending upwardly from the turntable 101.

Each energization of the stepper motor 85 (see FIG. 2) moves the lift arm 96 up. The lift arm 96 engages a puck 102' (see FIG. 3), which is slidably mounted on the spindle 102, to lift the puck 102' to engage the lowermost of the CDs 11 in the stack 100 at the supply position (the six o'clock position in FIG. 1C).

The stepper motor 85 (see FIG. 2) is energized by a sensor 103 (see FIG. 1C), which is mounted on the end of a fixed support arm 104 extending from a ring 105. The sensor 103 senses the absence of the uppermost of the CDs 11 in the stack 100 at the supply position (the six o'clock position) for insertion within the sleeve 12. This is usually when the uppermost of the CDs 11 is not present for insertion within the sleeve 12.

The ring 105 is clamped to a spindle housing 106. The spindle housing 106 is on the upper surface of a substantially horizontal base plate 107 (see FIG. 9), which is supported on the upper plate 16 of the support frame 15 by a spacer 107'.

Figure 12:
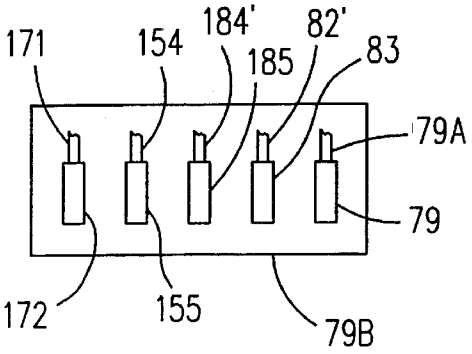
FIG. 12 is an enlarged fragmentary side elevational view of a sensor support and sensors supported thereby for use with the insert apparatus of the present invention.

As the sleeve 12 (see FIG. 1C) is advanced by the conveyor belt 19, the sleeve 12 passes a fiberoptic cable 82' of an infrared sensor 83 (see FIG. 12). The sensor 83 produces an electrical signal indicating that the sleeve 12 (see FIG. 1C) is at a specific linear position, which is a very small predetermined distance from where the CD 11 is to be inserted within the sleeve 12. The sensor 83 (see FIG. 12) is supported by the vertical plate 79B.

The electrical signal from the sensor 83 energizes a stepper motor 108 (see FIG. 9), which is mounted on the lower surface of the plate 107 and has its shaft 109 connected through a coupling 110 to a spindle 111. One suitable example of the stepper motor 108 is a stepper motor that is part of an indexer/drive package sold by Compumotor Division of Parker-Hannifin Corporation, Rohnert Park, Calif. as Model 088 SXF83-135-E. The coupling 110 is the same as the coupling 92 (see FIG. 2).

The commands for Power-up Sequence, Fault/Home Sequence and Main Sequence for programming the stepper motor 108, which is a series motor, are as follows:

```
;*************** POWER-UP SEQUENCE ***************
1XE100
1XD100
LD0
MN
MPA
OSB1
```

-continued

```
OSD0
OSG1
OSH1
OSJ0
GHA5
GHAD10
GHV-.1.5
GHF.1
A10
AD9
V3
XFK10
FEN90
FAC5.68
FOR1.800
FOL105
TF4
FSF1
FSI0
IN1A
IN2A
IN3A
IN4C
OUT1A
OUT2A
XG10
XT
;*************** FALUT/HOME SEQUENCE ***************
1XE10
1XD10
FSI0
NG
GH
PZ
D-1200
G
PZ
XG1
XT
;**************** MAIN SEQUENCE ****************
1XE1
1XD1
L
 IF(INXXXXX1) TR1 NIF
 O11
 T.09
 OX0
 TRXX0
 TRXX1
 FSI1
MPP
 D5850
 G
 FP5000
 O0X
NG
 T.08
 FSI0
MPP
 D0
 G
 FP2000
 O1X
NG
N
XT
```

These commands for power-up sequence, fault/home sequence, and main sequence are explained in *SX Indexer/Drive Software Reference Guide*, version 88-011871-01D, copyright 1993, of Compumotor Division of Parker-Hannifin Corporation, Rohnert Park, Calif. and in *SX/SXF Indexer/Drive User Guide*, version 88-011850-01G, copyright 1993, 1994, of Compumotor Division of Parker-Hannifin Corporation, Rohnert Park, Calif. With this invention, the program functions in the Motion Profiling Mode, which is described on pages 73–76 of the *User Guide*. The Motion Profiling Mode is identified as command MPP in the Main Sequence.

The spindle 111 (see FIG. 9), which has different diameters throughout its length and decreasing in size in a downward direction, is rotatably supported by a pair of roller bearings 112 and 113, which are disposed within a recess 114 in the spindle housing 106. A bearing spacer 115 maintains the bearings 112 and 113 in the desired spaced relation. The spindle 111 has its head bolted to a pick-up arm 116.

The stepper motor 108 is energized each time that one of the sleeves 12 (see FIG. 1C) is sensed by the sensor 83 (see FIG. 12) at a predetermined position. The predetermined position is a very small, predetermined distance from the load or insert position at which one of the CDs 11 (see FIG. 1C) is inserted within the sleeve 12.

The pick-up arm 116 (see FIG. 9) has a pick-up slide mount 117 bolted to its end. A pick-up slide 118 is bolted to the pick-up slide mount 117.

The pick-up slide 118 slidably supports a pair of guide rods 119. Each of the guide rods 119 is connected to a block 120. The blocks 120 are bolted to a top surface of a pick-up block 121.

The pick-up slide 118 has an air cylinder (not shown) therein to move the guide rods 119 and the connected blocks 120 down to enable the pick-up block 121 to pick up the uppermost of the CDs 11 (see FIG. 1C) in the stack 100 at the supply position (six o'clock position). Reversal of flow of the pressurized air to the air cylinder (not shown) lifts the pick-up block 121 (see FIG. 9) upwardly.

The limit of the upward motion is controlled by a pair of bolts 122 in an overlying portion 123 of the pick-up slide mount 117 engaging the tops of the guide rods 119. This position is adjustable through rotating each of the two bolts 122 into or out of the overlying portion 123 of the pick-up slide mount 117.

Figure 11:
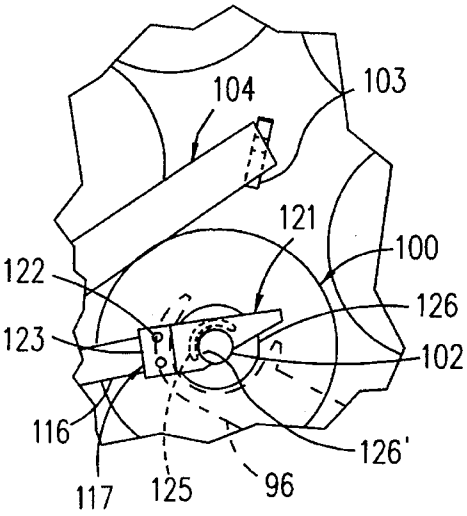
FIG. 11 is an enlarged fragmentary top plan view of a portion of the insert mechanism of FIG. 1C.

The pick-up block 121 has an arcuate groove 125 (see FIG. 11) in its bottom surface for applying a vacuum to the uppermost CD 11 (see FIG. 1C) in the stack 100 at the supply position (six o'clock position). The vacuum is applied only to the portion of the CD 11 defined by an annular area 126 around a central opening 126', which receives the spindle 102. The annular area 126 does not have any data thereon, and this is the only portion of the CD 11 to which no damage can occur by being touched.

The pick-up block 121 also includes an air hole 127 (see FIG. 9) for directing pressurized air to separate the top and bottom of the edge 14 (see FIG. 1C) of the sleeve 12 to enable the CD 11 to be easily inserted within the sleeve 12 during continuous movement of the sleeve 12 by the conveyor belt 19. Pressurized air is continuously supplied through the air hole 127 (see FIG. 9).

Figure 3:
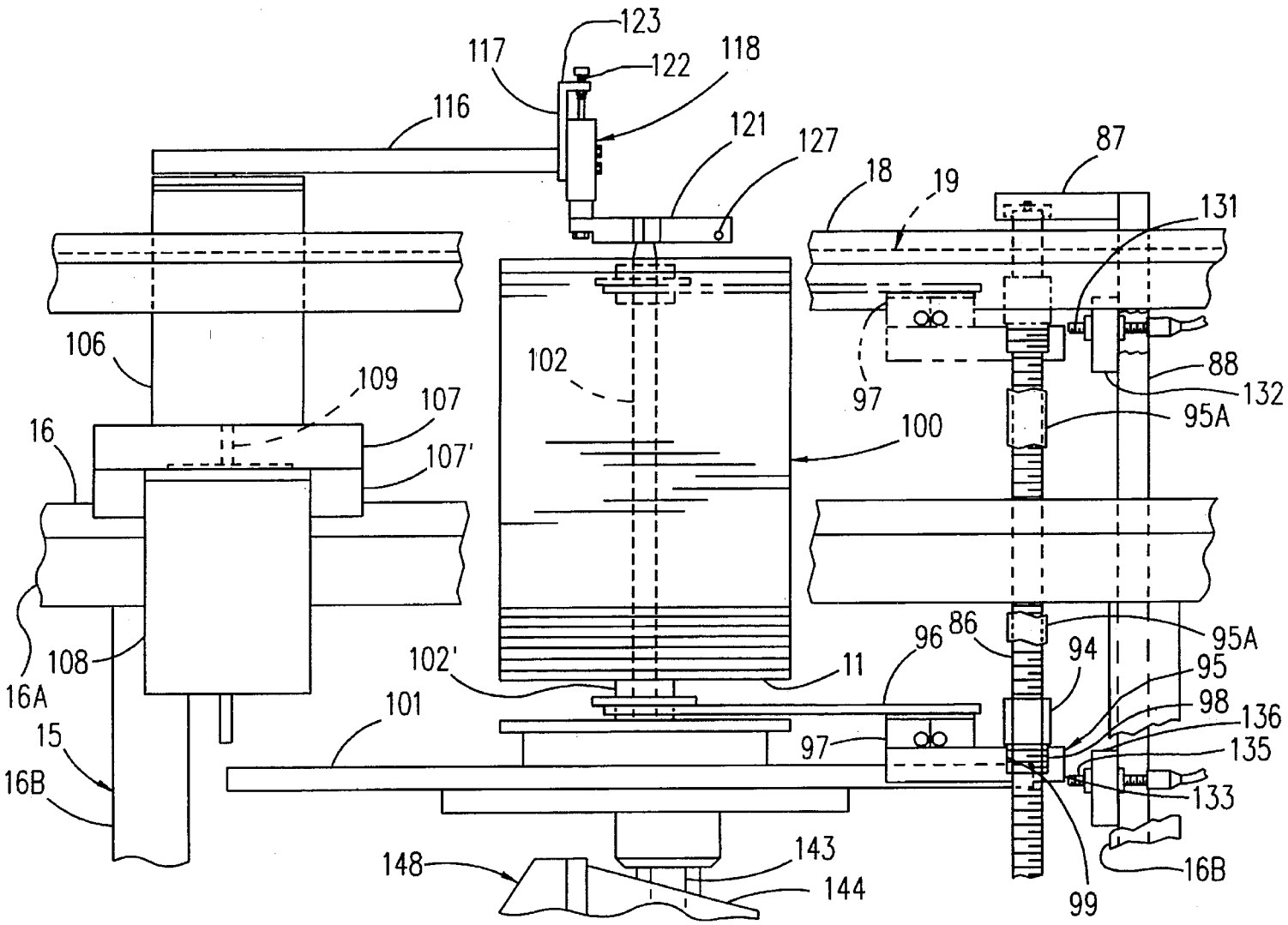
FIG. 3 is an enlarged fragmentary side elevational view of a portion of the insert apparatus of FIG. 2.

The vacuum in the arcuate groove 125 (see FIG. 11) is turned off and on by a software program that controls drive of the stepper motor 108 (see FIG. 3). It is necessary that the vacuum to the arcuate groove 125 (see FIG. 11) be turned off when the CD 11 (see FIG. 1C) is positioned for insertion into the open edge 14 of the sleeve 12 so that the CD 11 is released from the pickup block 121.

The stepper motor 108 (see FIG. 3) is programmed so that the CD 11 is moving at substantially the same linear speed as the sleeve 12 (see FIG. 1C) is being continuously advanced by the conveyor belt 19 when the CD 11 is inserted within the sleeve 12. The difference, if any, in the linear speeds of the CD 11 and the sleeve 12 is very small.

The incremental encoder 46 (see FIG. 5) provides a signal to the software program for the stepper motor 108 (see FIG. 2), which represents the linear speed of the conveyor belt 19. Through the manually controlled potentiometer 76' (see FIG. 13), the speed of the gear motor 66 can be changed to alter the linear speed of the conveyor belt 19 (see FIG. 2) to have substantially the same linear speed as the linear speed of a conveyor (not shown), for example, to which the sleeve 12 with the CD 11 therein is transported by the conveyor belt 19.

After the CDs 11 (see FIG. 1C) in the stack 100 on the spindle 102 at the supply position are exhausted, rotation of the lead screw 86 (see FIG. 2) by the stepper motor 85 ceases when an upper proximity switch 131 (see FIG. 4), which is supported by a bracket 132 adjustably supported on the vertical plate 88, senses the presence of a vertical surface 133 of the plate 95 and produces a signal. This signal causes reversal of the direction of rotation of the stepper motor 85 to return the ball nut 94 and the lift arm 96 to their lowermost positions. The bracket 132 (see FIG. 8) has two elongated slots 134 to enable adjustment of the bracket 132 on the vertical plate 88 to vertically adjust the position of the upper proximity switch 131, which is the same as the proximity switch 77 (see FIG. 1D).

When the lift arm 96 (see FIG. 4) returns to its lowermost position, a lower proximity switch 135, which is supported by a bracket 136 adjustably supported on the vertical plate 88 and is the same as the proximity switch 77 (see FIG. 1D), senses the presence of the vertical surface 133 (see FIG. 4) of the plate 95 and produces a signal. This signal causes the rotary pneumatic actuator 97 to be activated to move the lift arm 96 from a position in which it would be engaged by the next of the spindles 102 (see FIG. 1C) during rotation of the turntable 101 to its phantom line position in FIG. 1C in which it would not be engaged by the next of the spindles 102. The bracket 136 (see FIG. 8) is adjusted in the same manner as the bracket 132.

Figure 4:
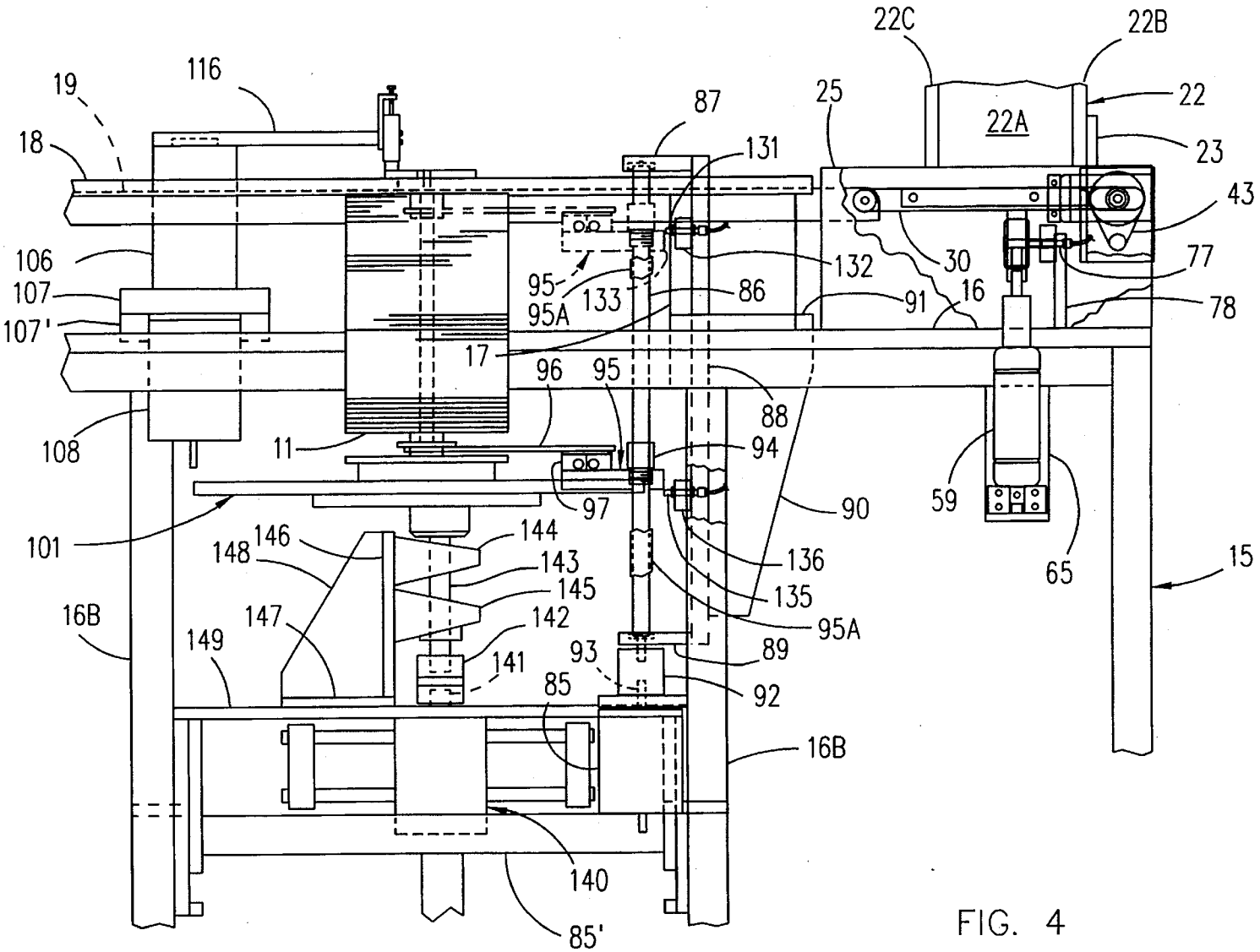
FIG. 4 is an enlarged fragmentary side elevational view of a portion of the insert apparatus of FIG. 2.

After rotation of the lift arm 96 (see FIG. 1C) is completed, the turntable 101 is rotated a predetermined angular amount by a rotary pneumatic indexer 140 (see FIG. 4). The rotary pneumatic indexer 140 has a shaft 141 connected through a coupling 142 to a shaft 143, which is fixed to the turntable 101. One suitable example of the coupling 142 is sold by McMaster-Carr Supply Company as three separate parts with two of the three parts being identical. Each the two identical parts is Model No. 6428K465, and the third part is Model No. 6428K56.

The shaft 143 rides in a pair of bearings 144 and 145, which are supported on a vertical plate 146. The vertical plate 146 is mounted on a horizontal plate 147. A plate 148 is fixed to each of the plates 146 and 147. The horizontal plate 147 is supported on a horizontal plate 149, which is supported by the vertical square tubes 16B of the support frame 15. One suitable example of each of the bearings 144 and 145 is a bearing sold by Dodge Reliance Electric Company, Greenville, S.C. as Model No. 124465.

As the turntable 101 (see FIG. 1C) is rotated clockwise by the rotary pneumatic indexer 140 (see FIG. 2), a sensor 150 (see FIG. 1C) senses whether the spindle 102, which is to be advanced to the supply position (six o'clock position in FIG. 1C) from its sensed position (four o'clock position in FIG. 1C), has one of the stacks 100 of the CDs 11 thereon. This is because the user may not employ one of the stacks 100 of the CDs 11 on all of the spindles 102 on the turntable 101.

If the spindle 102 at the sensed position does not have one of the stacks 100 of the CDs 11 thereon, the sensor 150 causes another activation of the rotary pneumatic indexer 140 (see FIG. 2) to rotate the turntable 101 (see FIG. 1C) clockwise to dispose another of the spindles 102 at the sensed position. One suitable example of the sensor 150 is an infrared sensor sold by Banner Inc., Florence, Ky. as Model No. SK12CVQD.

The sensor 150 is mounted on an L-shaped bracket 151, which is secured to the vertical plate 88. The sensor 150 insures that there is always one of the stacks 100 with the CDs 11 at the supply position if any of the spindles 102 on the turntable 101 has the stack 100 of the CDs 11 thereon.

As the conveyor belt 19 advances the sleeve 12 with the CD 11 partially inserted therein to the left in FIG. 1C from the load or insert position, the sleeve 12 (see FIG. 1B) passes a fiberoptic cable 154 of a sensor 155 (see FIG. 12). The fiberoptic cable 154 (see FIG. 1B) is supported by a bracket 156 on the guide rail 18 of the support frame 15 at a predetermined distance from the fiberoptic cable 82' (see FIG. 1C) of the sensor 83 (see FIG. 12). When a leading edge 157 (see FIG. 1C) of the sleeve 12 is sensed by the sensor 155 (see FIG. 12), an air cylinder 158 (see FIG. 1B), which is supported by a housing 159 of a push-in unit 160, is activated by a timer responding to a signal from the sensor 155 (see FIG. 12).

The air cylinder 158 has its piston rod 161 connected to a slide 162. The slide 162 has a pair of substantially parallel rods 163 connected thereto and slidably supported by the housing 159.

Thus, when the air cylinder 158 is activated by the sensor 155 (see FIG. 12) sensing the leading edge 157 (see FIG. 1C) of the sleeve 12, the piston rod 161 (see FIG. 1B) is retracted into the air cylinder 158 by applying pressurized air to the air cylinder 158 through a hole 164 in the housing 159 to act on a piston (not shown) within the air cylinder 158 and withdrawing pressurized air from the air cylinder 158 through a hole 165 in the housing 159.

The retraction of the piston rod 161 moves the slide 162 towards the straight surface 21 of the guide edge 18. This causes a push plate 166, which is bolted to the end of the slide 162, to engage the CD 11 to move it further into the sleeve 12.

The air cylinder 158 advances the push plate 166 until the push plate 166 engages a surface 167 of the housing 159 of the push-in unit 160. When the push plate 166 is returned to its original position by inactivation of the timer causing reversal of the flow of air pressure to the holes 164 and 165 a predetermined time after the sensor 155 (see FIG. 12) sensed the leading edge 157 (see FIG. 1C) of the sleeve 12, collars 169 (see FIG. 1B) on the rods 163 engage a surface 170 of the housing 159 of the push-in unit 160 to dispose the push plate 166 in the position of FIG. 1B.

As the sleeve 12 is advanced to the left in FIG. 1B, the sleeve 12 passes a fiberoptic cable 171 of a sensor 172 (see FIG. 12). The fiberoptic cable 171 is supported by a bracket 173 (see FIG. 1B) on the guide rail 18. This enables the sensor 172 (see FIG. 12), which is supported on the vertical plate 79B, to sense the leading edge 157 (see FIG. 1C) of the sleeve 12.

This causes activation of an air cylinder 174 (see FIG. 1B), which is supported by a housing 175 of a push-in unit 176 in the same manner as the air cylinder 158 is supported by the housing 159 of the push-in unit 160. The air cylinder 174 has its piston rod 177 connected to a slide 178 to cause the slide 178 and a push plate 179, which is bolted to the slide 178, to be moved towards the straight surface 21 of the guide edge 18. As a result, the push plate 179 moves the CD 11 completely into the sleeve 12. The slide 178 has a pair of substantially parallel rods 180 connected thereto and slidably supported by the housing 175.

Stopping of the motion of the push plate 179 of the push-in unit 176 in each direction is accomplished in the same manner as described for the push-in unit 160. Thus, the amount of motion of the push plate 179 in each direction is controlled.

The guide rail 18 has a fiberoptic cable 184' of a sensor 185 (see FIG. 12), which is mounted on the vertical plate 79B, supported thereon by a bracket 186 (see FIG. 1B). The bracket 186 is supported on the guide rail 18.

The fiberoptic cable 184' of the sensor 185 (see FIG. 12) is positioned to enable the sensor 185 to sense only whether the CD 11 (see FIG. 1B) has been inserted within the sleeve 12. If one of the CDs 11 has not been inserted in the sleeve 12, the sensor 185 (see FIG. 12) produces a signal to a timer to cause activation of an air cylinder 187 (see FIG. 10), which is bolted to a post 188 supported by the upper plate 16 of the support frame 15 between the push-in units 160 and 176. One suitable example of the air cylinder 187 is an air cylinder sold by Bimba Manufacturing Company, Monee, Ill. as Model No. FT-040.5.

Activation of the air cylinder 187 is by supplying pressurized air to one side of a piston (not shown) within the air cylinder 187 and exhausting pressurized air from the opposite side. This activation of the air cylinder 187 causes a block 189 on the end of a pair of piston rods 190 of the piston (not shown) to move upwardly and engage a portion of the sleeve 12 (see FIG. 1B) remote from the straight surface 21 of the guide edge 18. This tilts the sleeve 12 to remove the sleeve 12, which does not have one of the CDs 11 therein, from the conveyor belt 19 since the vacuum can no longer hold the tilted sleeve 12 on the conveyor belt 19. The guide edge 18 has a cut out portion 191 (see FIG. 10) in the straight surface 21 (see FIG. 1B) to allow the tilted sleeve 12 to fall therethrough from the conveyor belt 19.

Each of the sensors 79 (see FIG. 12), 83, 155, 173, and 185 is the same. One suitable example of the sensors is an infrared sensor sold by Banner Corp., Minneapolis, Minn. as Model No. SM312FQD Mini Beam 10–30 VDC.

While the element inserted into the container has been described as the CD 11 and the container has been described as the sleeve 12, it should be understood that any other element may be inserted into the container by the insert apparatus of the present invention. While the element has been shown as circular and the container as rectangular, it should be understood that the element and the container may have any other configurations as long as the element has a relatively tight fit within the container after the element in inserted therein. While the element had been shown as the relatively thin CD 11 and the container has been shown as the sleeve 12 being slightly thicker than the CD 11, it should be understood that the element does not have to be thin and that the container need only be slightly larger and have at least one edge open to enable the element to be inserted therein. It should be understood that the container may have more than one edge open.

Figure 22:
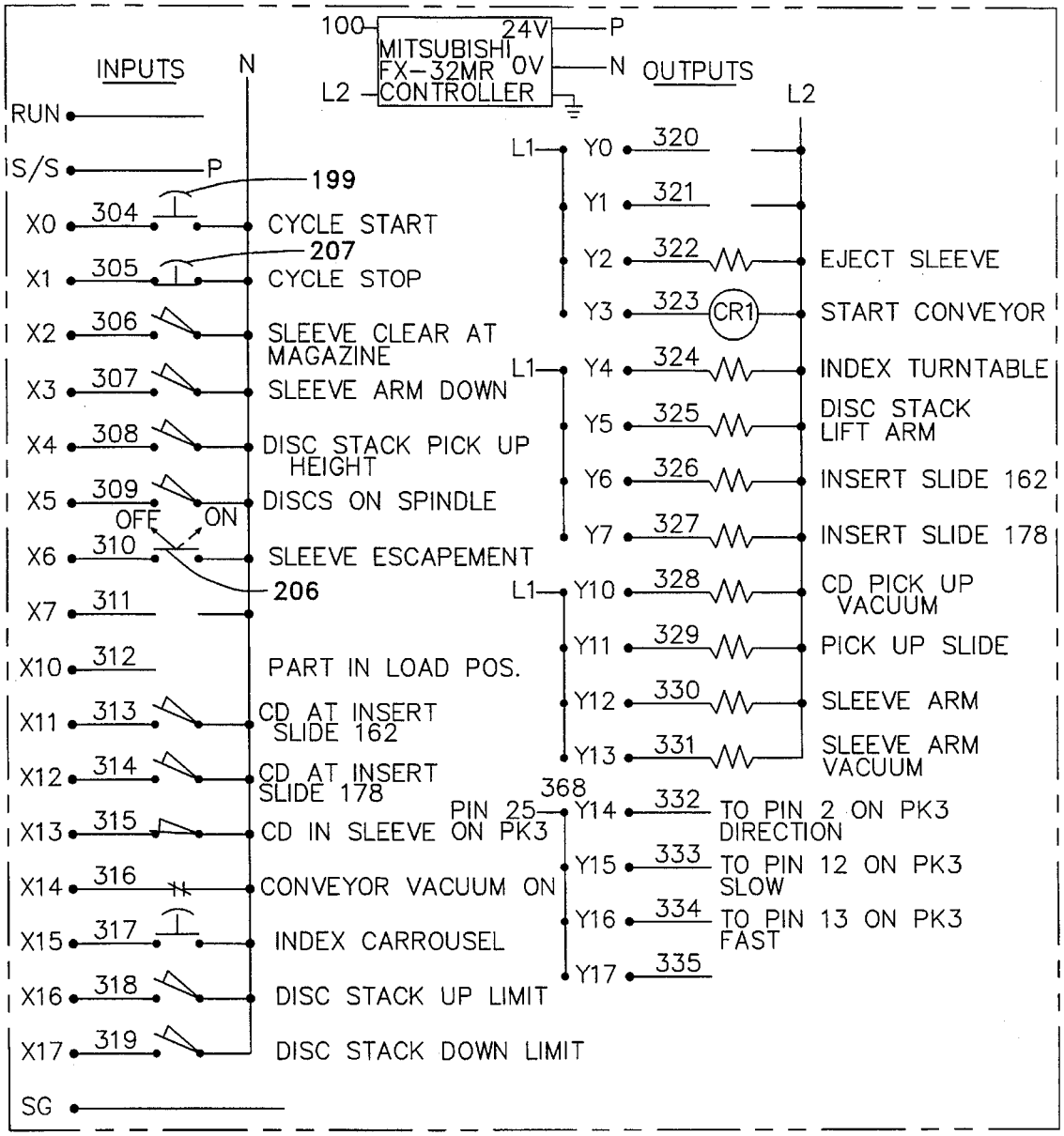
FIG. 22 is a schematic electrical diagram of the programmable controller used for controlling operation of the insert apparatus of the present invention.
Figure 23:
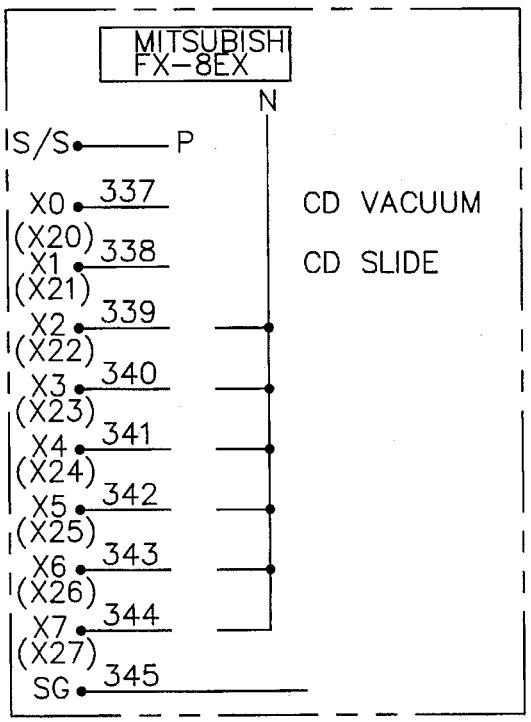
FIG. 23 is a schematic electrical diagram of an expansion block used with the programmable controller of FIG. 22.
Figure 24:
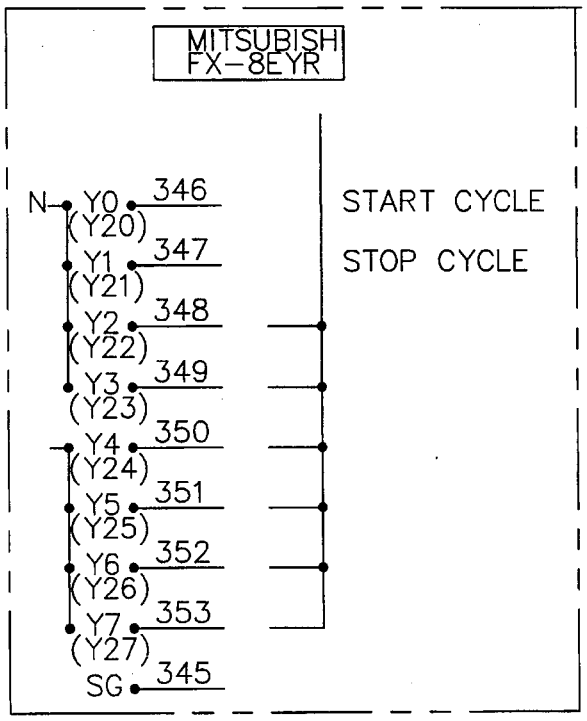
FIG. 24 is a schematic electrical diagram of another expansion block used with the programmable controller of FIG. 22.
Figure 25:
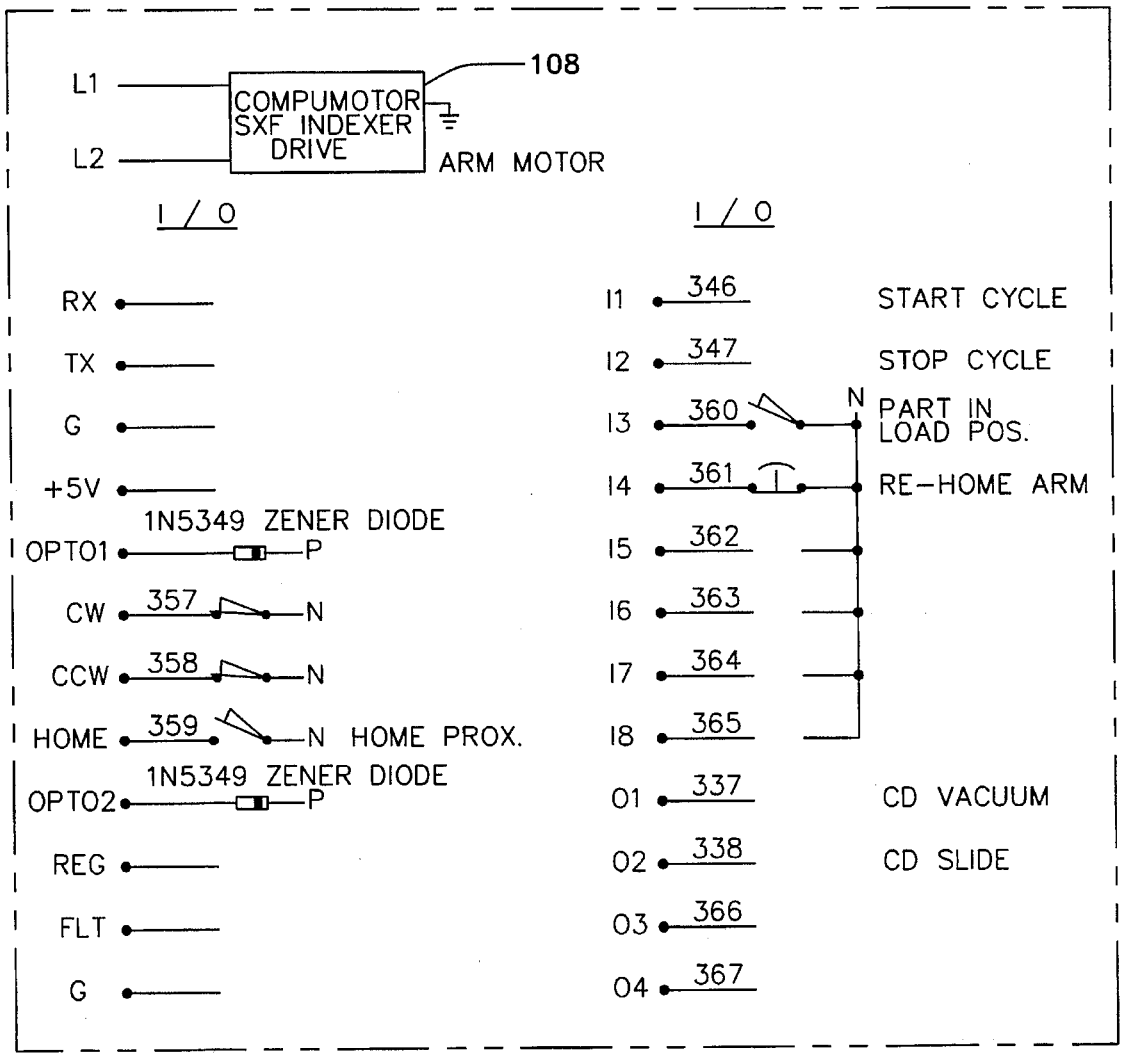
FIG. 25 is a schematic electrical diagram of an indexer/drive used with the insert apparatus of the present invention.
Figure 26:
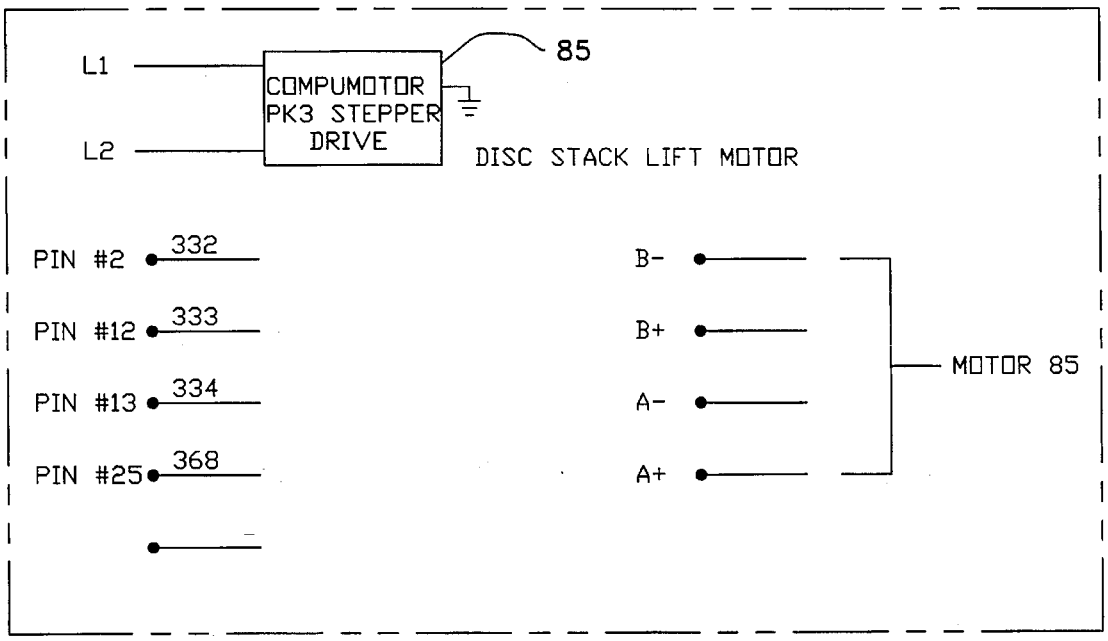
FIG. 26 is a schematic electrical diagram of a motor for lifting compact discs used with the insert apparatus of the present invention.

While the apparatus 10 may be controlled in any manner, a Mitsubishi programmable controller, MEL-SEF F1 series, is preferably used. A programmable controller FX-32MR (see FIG. 22) is employed along with two Mitsubishi expansion blocks FX-8EX (see FIG. 23) and FX-8EYR (see FIG. 24) with the expansion block FX-8EX (see FIG. 23) having eight inputs and the expansion block FX-8EYR (see FIG. 24) having eight outputs. FIGS. 15–21 show a ladder logic diagram using the Mitsubishi programmable controller FX-32MR (see FIG. 22) and the two expansion blocks FX-8EX (see FIG. 23) and FX-8EYR (see FIG. 24) with the apparatus 10 (see FIG. 1D).

When the apparatus 10 is to be started, a start push button 199 (see FIG. 22) is manually activated to cause energization of the gear motor 66 (see FIG. 1A). Activation of the start push button 199 (see FIG. 22) causes a normally open contact X0-1 (see FIG. 15) at rung R-0 to close.

Figure 6:
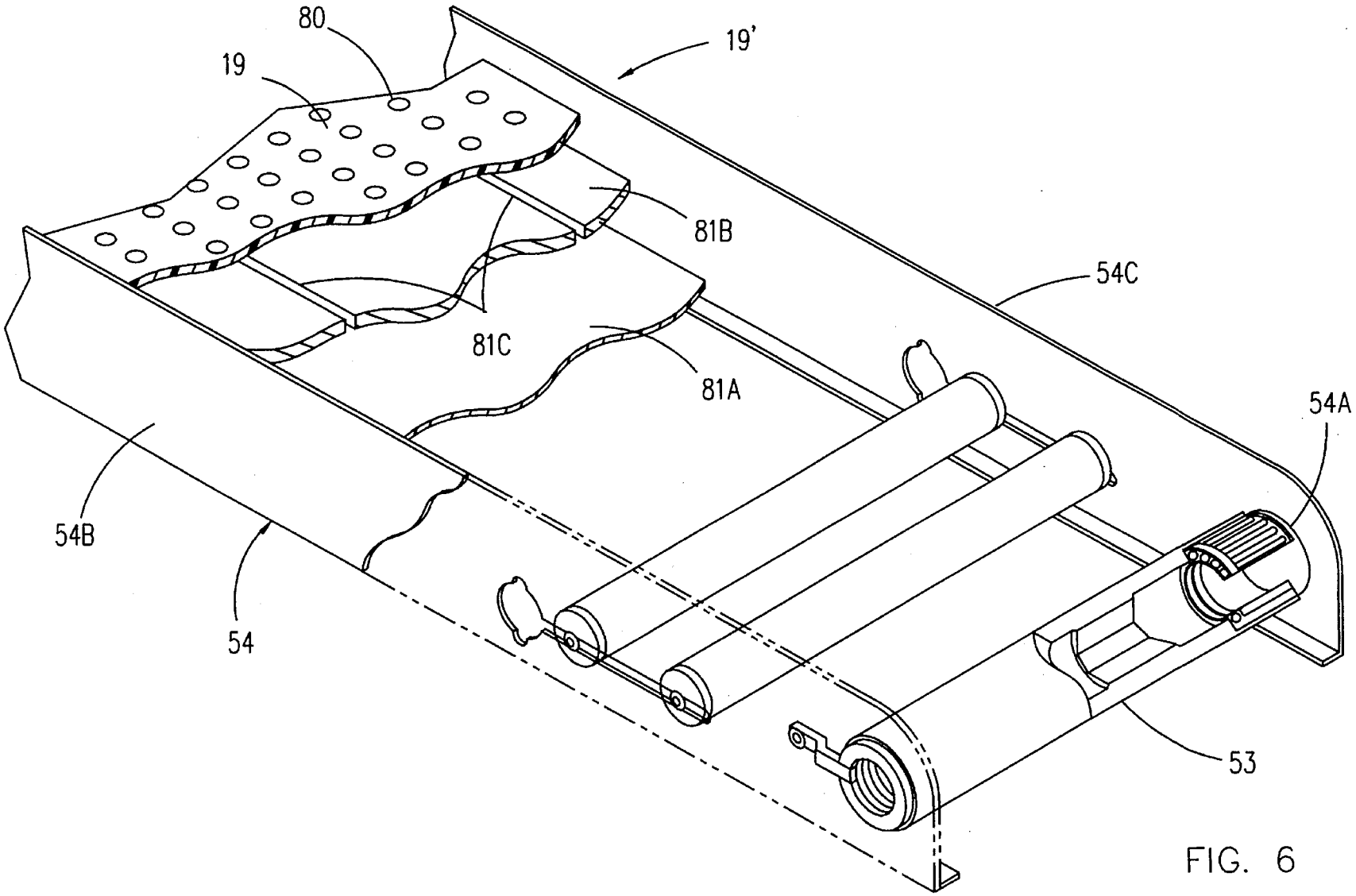
FIG. 6 is a fragmentary perspective view, partly in section, of a vacuum conveyor utilized in the insert apparatus of the present invention.
Figure 14:
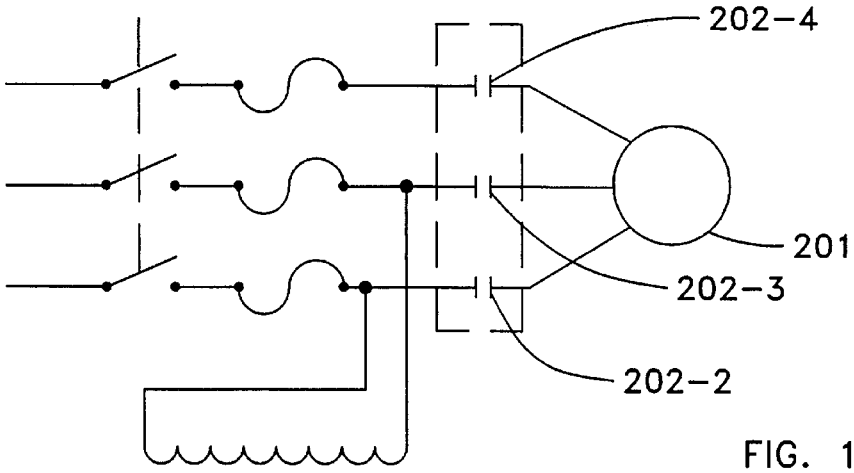
FIG. 14 is a schematic electrical diagram of a circuit for a vacuum fan motor used with the insert apparatus of the present invention.
Figure 27:
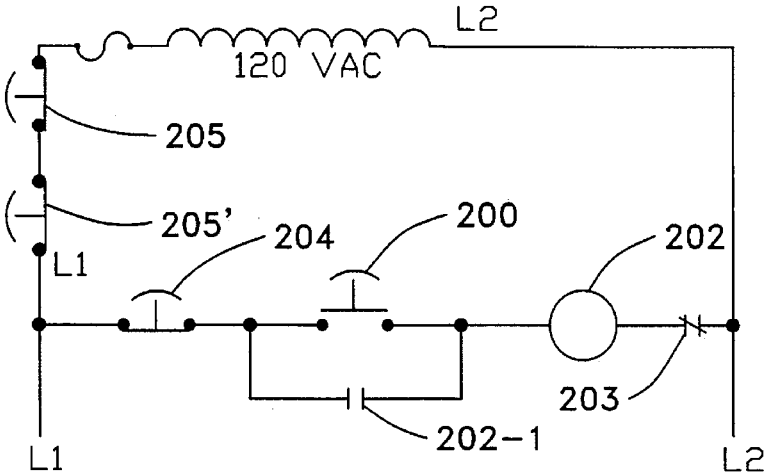
FIG. 27 is a schematic electrical diagram of a power supply used with the insert apparatus of the present invention.
Figure 27:
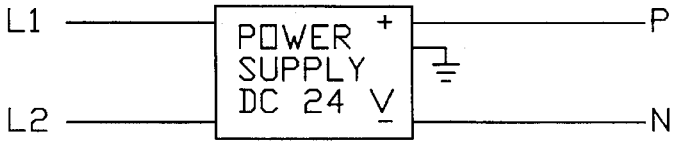

When a start push button 200 (see FIG. 14) is manually activated, a vacuum fan motor 201 is energized to produce a vacuum within the vacuum conveyor 19' (see FIG. 6). The push button 200 (see FIG. 14) closes a circuit through a starter relay coil 202 to start the vacuum fan motor 201.

Energization of the coil 202 closes its normally open contact 202-1 to provide a hold circuit for the coil 202 when the push button 200 is released. Energization of the coil 202 also closes its normally open contacts 202-2, 202-3, and 202-4 to supply power to the vacuum fan motor 201. Activation of the vacuum fan motor 201 causes a normally open contact X14-1 (see FIG. 15) at rung R-0 to close.

The circuit for the vacuum fan motor 201 (see FIG. 14) includes an overload trip switch 203 and a manual push button 204 for opening the circuit for the vacuum fan motor 201. There also are two manual push buttons 205 and 205' for opening the circuit for the vacuum fan motor 201 in an emergency. The push button 205 is located adjacent the apparatus 10 (see FIG. 1D), and the push button 205' (see FIG. 14) is located remote from the apparatus 10 (see FIG. 1A).

When the vacuum fan motor 201 (see FIG. 14) is energized, a coil M0 (see FIG. 15) at rung R-0 is energized provided that normally closed contacts M27-1 and X16-1 are closed. The normally closed contact M27-1 is closed since a coil M27 at rung R-19 is not energized when the apparatus 10 (see FIG. 1D) is started. The coil M27 (see FIG. 15) is only energized when it is desired to stop operation of the apparatus 10 (see FIG. 1D).

The normally closed contact X16-1 (see FIG. 15) at rung R-0 is closed when the upper proximity switch 131 (see FIG. 4) is open. The upper proximity switch 131 is closed only when it senses the presence of the vertical surface 133 of the plate 95 to produce a signal to cause the contact X16-1 (see FIG. 15) to open when the lift arm 96 (see FIG. 4) has completed its upper motion.

Therefore, the coil M0 (see FIG. 15) is activated if the plate 95 (see FIG. 4), which is driven upwardly by the lead screw 86 (see FIG. 4), is not in its uppermost position when the gear motor 66 (see FIG. 1A) and the vacuum fan motor 201 (see FIG. 14) are activated and the apparatus 10 (see FIG. 1A) is not stopped. The plate 95 is in its uppermost position only when there are no more of the CDs 11 (see FIG. 1C) in the stack 100.

Energization of the coil M0 (see FIG. 15) at rung R-0 causes its normally open contact M0-1 to close to latch the coil M0 in its energized state. Thus, it is not necessary for the start push button 199 (see FIG. 22) to continue to be held so that the contact X0-1 (see FIG. 15) at rung R-0 opens but the contact M0-1 latches the coil M0 energized.

Energization of the coil M0 also causes its normally open contact M0-2 (see FIG. 16) at rung R-49 to close. A normally closed contact T20-1 of a timer T20 at rung R-45 remains closed. Thus, a coil Y3 at rung R-49 is energized to cause a control relay CR1 (see FIGS. 13 and 22) to close to energize the gear motor 66 (see FIGS. 1A and 13) to start the conveyor belt 19 (see FIG. 1A). The coil Y3 (see FIG. 16) at rung R-49 is latched in its energized state by its normally open contact Y3-1 closing when the coil Y3 is energized.

The timer T20 at rung R-45 is activated for 0.1 second only when the coil M0 (see FIG. 15) at rung R-0 is deenergized. This occurs when the conveyor belt 19 (see FIG. 1A) is to be stopped. When the timer T20 (see FIG. 16) stops after being started by a normally closed switch M0-3 at rung R-45 returning from being open to its normally closed condition by the coil M0 (see FIG. 15) being deenergized, its contact T20-1 (see FIG. 16) at rung R-45 opens to deenergize the coil Y3.

When used with timers, each value of K indicates 0.1 of a second so that the numeral 1 in K1 at rung R-45 means 0.1 second. When used with a counter, the numeral in K indicates the number of counts before the counter stops to produce a signal.

When the coil M0 (see FIG. 15) at rung R-0 is energized to start the apparatus 10 (see FIG. 1A), a coil M28 (see FIG. 16) at rung R-65 is energized. This is because a normally open contact M0-4 of the coil M0 (see FIG. 15) closes when the coil M0 is energized and a normally closed contact T22-1 (see FIG. 16) of a timer T-22 at rung R-68 remains closed for one second after the coil M0 (see FIG. 15) is energized. This is due to the timer T-22 (see FIG. 16) being started when the coil M0 (see FIG. 15) is energized because a normally open contact M0-5 (see FIG. 16) at rung R-68 is closed.

Thus, the coil M28 at rung R-65 remains energized for one second so that its normally open contact M28-1 at rung R-59 is closed for one second. Closing of the normally open contact M28-1 energizes a coil Y12 at rung R-59 to cause a solenoid (not shown) to shift its position to change the direction of flow of pressurized air to the air cylinder 59 (see FIG. 5) to cause the arm 27 to be moved upwardly to its sleeve pick-up position.

When the air cylinder 59 moves the pivotally mounted arm 27 upwardly to pick up the lowermost of the sleeves 12 in the magazine 22, the proximity switch 77 (see FIG. 1D) can no longer sense the presence of the pivot pin 62 (see FIG. 5) of the clevis 60. As a result, a contact X3-1 (see FIG. 16) at rung R-72 closes to energize a coil Y13. Energization of the coil Y13 causes a vacuum to be applied to the vacuum cup 28 (see FIG. 5) on the pivotally mounted arm 27.

The coil Y12 (see FIG. 16) at rung R-59 is latched in its energized state by its contact Y12-1 if a contact X6-1 of a selector switch 206 (see FIG. 22) is closed since a normally closed contact T1-1 is closed when the coil Y12 is energized. The selector switch contact X6-1 (see FIG. 16) is opened only when it is desired to operate the conveyor belt 19 (see FIG. 1C) without the sleeves 12.

When the coil Y12 (see FIG. 16) at rung R-59 is energized, its normally open contact Y12-2 at rung R-74 closes to turn on the timer T1. After 0.3 second, the timer T1 times out and its normally closed contact Ti-1 at rung R-59 opens to deenergize the coil Y12.

Deenergization of the coil Y12 causes the solenoid (not shown) to shift its position to reverse the flow of pressurized air to the air cylinder 59 (see FIG. 5) so that the piston rod 61 is retracted. This causes the pressurized air flow to the air cylinder 59 (see FIG. 5) to be reversed. As a result, the pivotally mounted arm 27 is moved downwardly to deposit the sleeve 12 on the timing belts 30 and 31.

while the coil M28 (see FIG. 16) at rung R-65 remains energized for one second to keep the coil Y12 at rung R-59 energized for one second in the first cycle of operation, the hold circuit through the normally closed contact T22-1 is on for only 0.3 second. After the first cycle of operation, the coil M28 at rung R-65 is not energized until the coil M0 (see FIG. 15) at rung R-0 is deenergized and then again energized. Thus, control of the air cylinder 59 (see FIG. 5) after the first cycle of operation is by the sensor 79 (see FIG. 12) sensing when the sleeve 12 (see FIG. 1D) moves onto the conveyor belt 19.

When the sensor 79 (see FIG. 12) senses the presence of the sleeve 12 (see FIG. 1D) reaching the conveyor belt 19, a contact X2-1 (see FIG. 16) at rung R-55 closes to produce a pulse in a coil M2. At the time that the pulse is produced in the coil M2 to close its normally open contact M2-1 at rung R-59, the contact T1-1 at rung R-59 also is closed. This is because the timer T1, which turned off the coil Y12 after being on for 0.3 second, returned to its initial state when the coil Y12 was deenergized.

Therefore, the pulse to the coil M2 at rung R-55 causes energization of the coil Y12 at rung R-59 to change the direction of motion of the piston rod 61 (see FIG. 5) in the air cylinder 59 through changing the direction of flow of pressurized air to the air cylinder 59. Thus, the coil Y12 (see FIG. 16) at rung R-59 is always energized by the coil M2 at rung R-55 being pulsed after the first cycle of operation from when the start push button 199 (see FIG. 22) was manually depressed to start operation of the apparatus 10 (see FIG. 1C).

After the sleeve 12 has passed the supply position at which one of the CDs 11 is to be inserted, the sensor 185 (see FIG. 12) senses whether the sleeve 12 has one of the CDs 11 inserted therein. If one of the CDs 11 is not inserted within the sleeve 12, the sensor 185 (see FIG. 12) closes a normally open contact X13-1 (see FIG. 17) at rung R-89. If the sensor 185 (see FIG. 12) senses that one of the CDs 11 (see FIG. 1C) is in the sleeve 12, then the normally open contact X13-1 (see FIG. 17) at rung R-89 remains open.

As the conveyor belt 19 (see FIG. 1C) advances the sleeve 12 with or without one of the CDs 11, the sensor 155 (see FIG. 12) senses the presence of the sleeve 12 (see FIG. 1B) with or without one of the CDs 11; this sensing closes a normally open contact X11-1 (see FIG. 17) at rung R-115. This supplies a pulse to a coil M8 to close its normally open contact M8-1 at rung R-118. This energizes a coil Y6 because a timer T9 at rung R-122 is off so that its normally closed contact T9-1 at rung R-118 remains closed.

The coil Y6 is latched in its energized position by its normally open contact Y6-1 being closed when the coil Y6 is energized. Therefore, the coil Y6 remains energized after the coil M8 ceases to be pulsed so that the normally open contact M8-1 returns to this condition.

The energization of the coil Y6 causes reversal of the flow of pressurized air to the air cylinder 158 (see FIG. 1B) to retract the piston rod 161 into the air cylinder 158. This causes the CD 11, if there is one within the sleeve 12, to be moved by the push plate 166 of the push-in unit 160 further into the sleeve 12 than it was inserted at the supply position.

Energization of the coil Y6 (see FIG. 17) at rung R-118 causes its normally open contact Y6-2 at rung R-122 to close. This activates the timer T9 for 0.3 second after which its normally closed contact T9-1 at rung R-118 opens to deenergize the coil Y6. When the coil Y6 is deenergized, the air cylinder 158 (see FIG. 1B) is moved in the opposite direction to remove the push plate 166 from engagement with the CD 11, if one of the CDs 11 is inserted within the sleeve 12.

When the sensor 155 (see FIG. 12) sense the presence of one of the sleeves 12 (see FIG. 1B) on the conveyor belt 19, a normally open contact X11-2 (see FIG. 17) at rung R-82 and a normally open contact X11-3 at rung R-85 are closed. The closing of the contact X11-2 at rung R-82 causes energization of a coil M3 since a normally closed contact T3-1 of a timer T3 at rung R-85 is closed.

The timer T3 is energized for 0.1 second when the normally open contact X11-3 closes. When the timer T3 times out after 0.1 second, its normally closed contact T3-1 at rung R-82 opens to deenergize the coil M3.

Energization of the coil M3 closes its normally open contact M3-1 at rung R-89. If the sleeve 12 (see FIG. 1C) did not have one of the CDs 11 inserted therein as determined by the sensor 185 (see FIG. 12), then the normally open contact X13-1 (see FIG. 17) at rung R-89 is closed.

With a contact T24-1 of a timer T24 at rung R-94 being closed when the timer T24 is turned off by a normally closed contact X11-4 opening when the sensor 155 (see FIG. 12) senses the leading edge 157 (see FIG. 1C) of the sleeve 12, a coil M7 (see FIG. 17) at rung R-89 is energized. Energization of the coil M7 causes its normally open contact M7-1 to latch the coil M7 in its energized state since the coil M3 at rung R-82 remains energized for only 0.1 second due to the length of time that the timer T3 at rung R-85 is turned on.

The normally open contact X13-1 at rung R-89 also remains closed for only a very short period of time. This is because the sleeve 12 (see FIG. 1C) is advanced rapidly past the sensor 185 (see FIG. 12).

With the coil M7 (see FIG. 17) at rung R-89 energized, a contact M7-2 at rung R-98 also is closed. A normally closed contact X11-5 and the normally closed contact X11-4 at rung R-94 are returned to their closed positions since the sleeve 12 (see FIG. 1B) has passed the sensor 155 (see FIG. 12) so that the sensor 155 is no longer sensing the presence of the sleeve 12 (see FIG. 1B). This indicates that the sleeve 12 is between the push-in units 160 and 176.

With a normally closed contact T2-1 (see FIG. 17) at rung R-98 of a timer T2 at rung R-103 closed, a coil Y2 at rung R-98 is energized. This closes its normally open contact Y2-1 to provide a latch to hold the coil Y2 energized until the normally closed contact T2-1 of the timer T2 at rung R-103 opens 0.2 second after the coil Y2 at rung R-98 is energized.

Energization of the coil Y2 causes its normally open contact Y2-2 at rung R-103 to close whereby the timer T2 turns on for 0.2 second. When the timer T2 turns off, its normally closed contact T2-1 at rung R-98 opens to deenergize the coil Y2.

Energization of the coil Y2 causes activation of the air cylinder 187 (see FIG. 10) to move the block 189 upwardly. This causes the sleeve 12 (see FIG. 1B), which does not have one of the CDs 11 therein, to be tilted and removed from the conveyor belt 19 through the cut out portion 191 (see FIG. 10) in the straight surface 21 (see FIG. 1B) of the guide edge 18 so that the sleeve 12, which does not have one of the CDs 11 therein, falls from the conveyor belt 19.

When the normally closed contact X11-4 (see FIG. 17) at rung R-94 returns to its closed position after the sleeve 12 (see FIG. 1B) is no longer sensed by the sensor 155 (see FIG. 12), the timer T24 (see FIG. 17) at rung R-94 turns on 0.1 second thereafter to open the contact T24-1 at rung R-89 to deenergize the coil M7. The contact T24-1 stays open until the leading edge 157 (see FIG. 1C) of the next of the sleeves 12 is sensed by the sensor 155 (see FIG. 12).

When the sleeve 12 (see FIG. 1B) has one of the CDs 11 therein, the conveyor belt 19 continues to advance the sleeve 12 because the air cylinder 187 is not activated. If one of the sleeves 12 without one of the CDs 11 therein should not be ejected through the cut out portion 191 (see FIG. 10) in the straight surface 21 (see FIG. 1B) of the guide edge 18, the sleeve 12 without the CD 11 would continue to be advanced by the conveyor belt 19.

In any event, each of the sleeves 12, which passes the cut out portion 191 (see FIG. 10) in the straight surface 21 (see FIG. 1B) of the guide edge 18 without being ejected therethrough, is sensed by the sensor 172 (see FIG. 12). When this occurs, a normally open contact X12-1 (see FIG. 18) at rung R-126 is closed to pulse a coil M9.

Pulsing of the coil M9 closes its normally open contact M9-1 at rung R-129. This energizes a coil Y7 because a normally closed contact T16-1 of a timer T16 at rung R-133 is closed. Energization of the coil Y7 at rung R-129 closes its normally open contact Y7-1 to latch the coil Y7 in its energized position when the normally open contact M9-1 opens upon the coil M9 at rung R-126 ceasing to be pulsed.

Energization of the coil Y7 at rung R-129 also closes its normally open contact Y7-2 at rung R-133. This turns on the timer T16 for 0.3 second. When the timer T16 turns off after 0.3 second, its normally closed contact T16-1 at rung R-129 turns off to deenergize the coil Y7.

Energization of the coil Y7 cause a solenoid (not shown) to move in a direction to cause activation of the air cylinder 174 (see FIG. 1B) through reversing the direction of flow of pressurized air to the air cylinder 174. This causes the push plate 179 of the push-in unit 176 to move the CD 11 completely into the sleeve 12. Deenergization of the coil Y7 (see FIG. 18) at rung R-129 after 0.3 second moves the solenoid (not shown) in the opposite direction to reverse the direction of flow of pressurized air to the air cylinder 174 (see FIG. 1B) to return the push plate 179 to its rest or home position.

When the coil Y2 (see FIG. 17) at rung R-98 is energized because the sensor 185 (see FIG. 12) did not sense one of the CDs 11 (see FIG. 1B) in the sleeve 12, its normally open contact Y2-3 at rung R-107 closes. A counter C0 has its count advanced by one each time that the normally open contact Y2-3 closes. The counter CD is an internal counter in the Mitsubishi programmable controller FX-32MR.

If the count in the counter C0 reaches 10 because the sensor 185 (see FIG. 12) did not sense one of the CDs 11 (see FIG. 1B) in the sleeve 12 for ten consecutive of the sleeves 12, the counter C0 (see FIG. 17) at rung R-107 is energized to close its normally open contact C0-1 (see FIG. 15) at rung R-19 to energize the coil M27 at rung R-19.

Energization of the coil M27 opens its normally closed contact M27-1 at rung R-0 to deenergize the coil M0. This stops operation of the apparatus 10 (see FIG. 1A).

When the sensor 185 (see FIG. 12) senses one of the sleeves 12 (see FIG. 1B) having one of the CDs 11 therein before the counter C0 (see FIG. 17) reaches a count of ten, a normally open contact X12-2 at rung R-111 closes. This resets the counter C0 to a count of 0.

Figure 10:
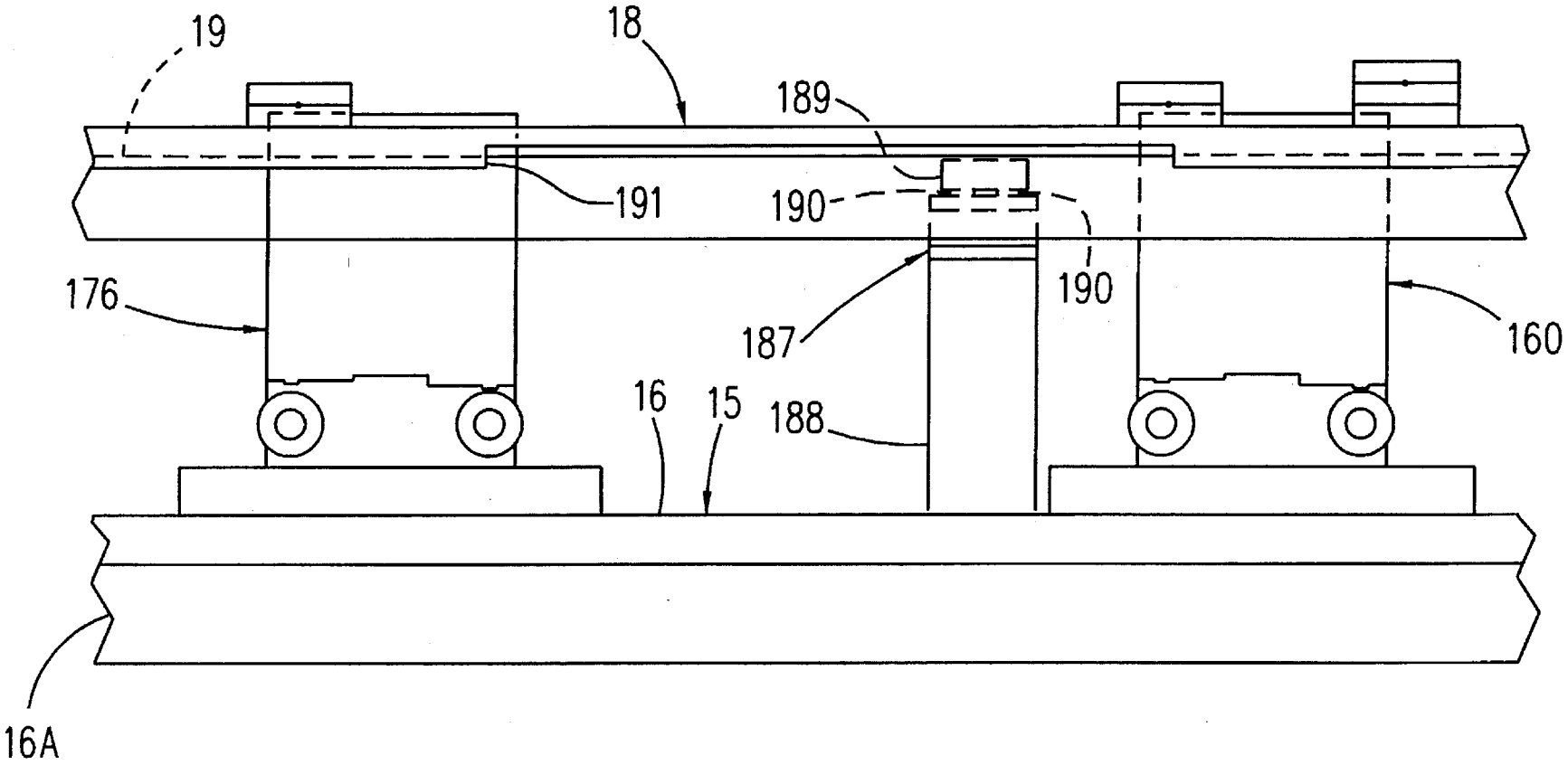
FIG. 10 is an enlarged fragmentary side elevational view of the portion of the insert apparatus of FIG. 1B.

The sensor 185 (see FIG. 12) closes the contact X12-2 (see FIG. 17) at rung R-111 only when the sleeve 12 (see FIG. 1B) has not been ejected by the air cylinder 187 (see FIG. 10). This normally means that one of the sleeves 12 (see FIG. 1C) has one of the CDs 11 therein prior to the counter C0 reaching a count of ten. The counter C0 also is reset to a count of 0 whenever the manual push button 199 (see FIG. 22), which starts operation of the apparatus 10 (see FIG. 1A), is activated by a normally open contact X0-2 (see FIG. 17) at rung R-111 closing.

The turntable 101 (see FIG. 1C) is rotated or indexed a predetermined angular amount, which is equal to the angular distance between two adjacent of the spindles 102, each time that the rotary pneumatic indexer 140 (see FIG. 8) is activated. The rotary pneumatic indexer 140 can be activated by a manual push button, automatically when there are no more of the CDs 11 (see FIG. 1C) on the spindle 102, or automatically repeated when the sensor 150 does not sense the presence of any of the CDs 11 on the spindle 102 at the sensed position prior to its advancement to the supply position.

When the manual push button is pushed to activate the rotary pneumatic indexer 140 (see FIG. 8), a normally open contact X15-1 (see FIG. 18) at rung R-137 is closed. A normally open contact X17-1 is closed only when the lower proximity switch 135 (see FIG. 4) senses the presence of the vertical surface 133 of the plate 95 with this sensing occurring only at the lowermost position of the lift arm 96.

Therefore, when the lift arm 96 is at its lowermost position, the normally open contact X17-1 (see FIG. 18) at rung R-137 is closed, and the push button is manually activated to close the normally open contact X15-1, a coil Y4 is energized provided that each of normally closed contacts Y16-1, M29-1, M6-1, and T7-1 is closed.

The normally closed contact Y16-1 opens only when a coil Y16 (see FIG. 20) at rung R-240 is energized. The coil Y16 is energized only when the stepper motor 85 (see FIG. 2) is energized to rotate the lead screw 86.

The normally closed contact M29-1 (see FIG. 18) at rung R-137 of a coil M29 (see FIG. 19) at rung R-195 is opened only when it is desired to rotate the lift arm 96 (see FIG. 4) through the rotary pneumatic actuator 97 to remove the lift arm 96 from the rotary path of the turntable 101. The normally closed contact M6-1 (see FIG. 18) at rung R-137 is opened only when a coil M6 at rung R-161 is energized.

The coil M6 is energized only when both a normally open contact Y4-1 of a coil Y4 at rung R-137 and a normally open contact X5-1 are closed and a normally closed contact M29-2 of the coil M29 (see FIG. 19) at rung R-195 remains closed. The normally open contact X5-1 (see FIG. 18) at rung R-161 closes only when the sensor 150 (see FIG. 1C) senses that the spindle 102 at the sensed position has none of the CDs 11 thereon. This cannot occur when the spindle 102 at the sensed position has the CDs 11 thereon. Therefore, whenever the contact X15-1 (see FIG. 18) at rung R-137 is closed, the normally closed contact M6-1 is closed. The turntable 101 (see FIG. 1C) is always stopped after being rotated with the spindle 102 at the sensed position having the CDs 11 thereon.

The normally closed contact T7-1 (see FIG. 18) of the timer T7 at rung R-157 remains closed prior to the coil Y4 at rung R-137 being energized because the timer T7 at rung R-157 is turned on only when a normally open contact Y4-2 of the coil Y4 closes. This occurs only when the coil Y4 is energized. Accordingly, the turntable 101 (see FIG. 2) can be manually indexed only when the lift arm 96 is at its lowermost position.

The only difference in the circuit between manual indexing by manually activating the push button to close the normally open contact X15-1 (see FIG. 18) at rung R-137 and automatic indexing is the use of a normally open contact M15-1 in place of the normally open contact X15-1. The normally open contact M15-1 closes only after the lift arm 96 (see FIG. 2) has been moved to its uppermost position and returned to its lowermost position; this is when a timer T10 (see FIG. 19) at rung R-204 is energized to close its normally open contact T10-1 (see FIG. 21) at rung R-280. Thus, automatic rotation or indexing of the turntable 101 (see FIG. 1C) occurs only after the lift arm 96 (see FIG. 2) has been moved to its uppermost position and returned to its lowermost position.

The timer T10 (see FIG. 19) at rung R-204 is turned on only when both a normally open contact M12-1 of a coil M12 at rung R-199 is closed and a normally open contact X17-2 is closed. The normally open contact X17-2 is closed when the lower proximity switch 135 (see FIG. 4) has sensed that the lift arm 96 has returned to its lowermost position.

The coil M12 (see FIG. 19) at rung R-199 is energized only after both a normally open contact X16-2 and a normally open contact M29-3 close. When the coil M12 is energized, its normally open contact M12-2 closes to provide a hold circuit through the contact M29-3 to hold the coil M12 energized.

The normally open contact X16-2 is closed by the upper proximity switch 131 (see FIG. 4) sensing that the lift arm 96 has reached its uppermost position. The normally open contact M29-3 (see FIG. 19) at rung R-199 closes only when the coil M29 at rung R-195 is energized.

The coil M29 is energized only when a normally closed contact T10-2 of the timer T10 at rung R-204 remains closed by the timer T10 at rung R-204 not being on and a timer T8 at rung R-187 having timed out after 2.3 seconds to close its normally open contact T8-1 at rung R-195. The timer T8 at rung R-187 is turned on only when a normally closed contact X15-2 remains closed because the manual push button has not been activated to rotate or index the turntable 101 (see FIG. 1C). The normally open contact M6-2 (see FIG. 19) at rung R-187 is open unless the coil M6 (see FIG. 18) at rung R-161 is energized.

As previously mentioned, the coil M6 is energized only when both the normally open contact Y4-1 of the coil Y4 at rung R-137 and the normally open contact X5-1 at rung R-161 are closed while the normally closed contact M29-2 remains closed. The normally closed contact M29-2 is opened only by the coil M29 (see FIG. 19) at rung R-195 being energized.

As previously discussed, the coil M29 can only be energized by the normally open contact T8-1 of the timer T8 at rung R-187 being closed. The normally open contact T8-1 at rung R-195 closes only after the timer T8 at rung R-187 has been turned on for 2.3 seconds. The timer T8 turns on only when the coil M6 (see FIG. 18) at rung R-161 is energized to close the normally open contact M6-2 (see FIG. 18) at rung R-161.

The normally open contact Y4-1 (see FIG. 18) at rung R-161 closes when the coil Y4 at rung R-137 is energized. This is when the turntable 101 (see FIG. 1C) is to be rotated or indexed.

The normally open contact X5-1 (see FIG. 18) at rung R-161 is closed when the sensor 150 (see FIG. 1C) senses that the spindle 102 at the sensed position does not have any of the CDs 11 thereon so that it is necessary to rotate the turntable 101.

When the coil M6 (see FIG. 18) at rung R-161 is energized, the normally open contacts M6-2 (see FIG. 19) at rung R-187 and M6-3 (see FIG. 18) at rung R-161 are closed. Closing of the normally open contact M6-3 provides a hold circuit through the normally closed contact M29-2 to hold the coil M6 energized.

Closing of the normally open contact M6-2 (see FIG. 19) at rung R-187 turns on the timer T8. When the timer T8 turns off after 2.3 seconds, its normally open contact T8-1 at rung R-195 closes to energize the coil M29. A normally open contact M29-4 is closed to latch the coil M29 in its energized condition through the normally closed contact T10-2 after the coil M29 is energized.

Energization of the coil M29 closes its normally open contact M29-3 at rung R-199. Since the normally open contact X16-2 was closed when the upper proximity switch 131 (see FIG. 4) sensed that the lift arm 96 was at its uppermost position, the coil M12 (see FIG. 19) at rung R-199 is energized. This closes its normally open contact M12-2 to latch the coil M12 in its energized condition through the normally open contact M29-3, which is closed because the coil M29 at rung R-195 is energized.

When the lower proximity switch 135 (see FIG. 4) senses that the lift arm 96 is at its lowermost position, the normally open contact X17-2 (see FIG. 19) at rung R-204 is closed to turn on the timer T10 for 0.5 second since the normally open contact M12-1 is already closed. When the timer T10 is turned off, its normally open contact T10-1 (see FIG. 21) at rung R-280 is closed. Since a normally closed contact M15-2 is closed, closing of the normally open contact T10-1 energizes a coil M22.

Energization of the coil M22 closes its normally open contact M22-1 to latch the coil M22 in its energized state through the normally closed contact M15-2. With the coil M22 energized, its normally open contact M22-2 at rung R-284 closes to turn on a timer T14 for one second. When the timer T14 is turned off, its normally open contact T14-1 at rung R-288 is closed to pulse a coil M15. The coil M15 closes its contact M15-1 (see FIG. 18) at rung R-137 whereby the coil Y4 is energized to automatically rotate or index the turntable 101 (see FIG. 1C). Energization of the coil M15 (see FIG. 21) at rung R-280 by the pulse opens the normally closed contact M15-2 to deenergize the coil M22; this opens the normally open contact T14-1 at rung R-288.

A normally open contact Y4-3 (see FIG. 18) at rung R-137 of the coil Y4 becomes a latch circuit with the normally closed contact T7-1 to maintain the coil Y4 energized after the pulse to the coil M15 ceases. The timer T7 at rung R-157 is turned off 0.6 second after the normally open contact Y4-2 of the coil Y4 was closed. Thus, the signal for automatically rotating or indexing the turntable 101 (see FIG. 1C) through energizing the coil Y4 (see FIG. 18) at rung R-137 is applied for only 0.6 second.

If the sensor 150 (see FIG. 1C) does not sense the presence of the CDs 11 on the spindle 102 at the sensed position, the rotary pneumatic indexer 130 (see FIG. 2) is again activated to rotate or index the turntable 101 automatically to advance the turntable 101 to dispose another of the spindles 102 (see FIG. 1C) at the sensed position. This is accomplished by a normally open contact M10-1 (see FIG. 18) at rung R-137 of a coil M10 at rung R-176 being closed when the coil M10 is energized.

The coil M10 is energized when both a normally closed contact C1-1 at rung R-176 of a counter C1 at rung R-179 and a normally open contact T19-1 at rung R-176 of a timer T19 at rung R-172 are closed. The normally closed contact C1-1 at rung R-176 opens only upon the counter C1 at rung R-179 reaching a count of four when there are five of the spindles 102 (see FIG. 1C) on the turntable 101. If the turntable 101 has more or less than five of the spindles 102, then the normally closed contact C1-1 (see FIG. 18) at rung R-176 opens when its count is one less than the total number of the spindles 102 (see FIG. 1C) on the turntable 101. Thus, the contact C1-1 (see FIG. 18) at rung R-176 opens when all of the spindles 102 (see FIG. 1C) have been at the sensed position.

The coil M10 (see FIG. 18) is energized when the timer T19 at rung R-172 is turned off after being on for 2.3 seconds because the normally open contact T19-1 at rung R-176 closes when the timer T19 at rung R-172 is turned off. The timer T19 is turned on when a normally open contact M21-1 of a coil M21 at rung R-166 is closed by the coil M21 being energized. The coil M21 is energized when both a normally open contact Y4-4 of the coil Y4 at rung R-137 and a normally open contact XI-1 at rung R-166 are closed while both a normally closed contact X5-2 and a normally closed contact M10-2 of the coil M10 at rung R-176 remain closed. Because the apparatus 10 (see FIG. 1C) is stopped when the turntable 101 is rotated or indexed, the normally open contact XI-1 (see FIG. 18) at rung R-166 will be closed. The normally open contact Y4-4 is closed when the coil Y4 at rung R-137 is energized.

The normally closed contact X5-2 remains closed when there is none of the CDs 11 (see FIG. 1C) on the spindle 102 at the sensed position. This is determined by the sensor 150 sensing the absence of the CDs 11.

Accordingly, energization of the coil M21 (see FIG. 18) at rung R-166 closes its normally open contact M21-1 at rung R-172 to turn on the timer T19 for 2.3 seconds. A normally open contact M21-2 at rung R-166 also closes to form a hold circuit through the contacts M10-2 and XI-1 to hold the coil M21 energized.

When the timer T19 at rung R-172 turns off, its normally open contact T19-1 at rung R-176 closes to energize the coil M10. This closes the normally open contact M10-1 at rung R-137 to automatically repeat rotation or indexing of the turntable 101 (see FIG. 1C).

Each energization of the coil M10 (see FIG. 18) at rung R176 closes its normally open contact M10-3 at rung R-179. Each closing of the normally open contact M10-3 increases the count in the counter C1 until it reaches a count of four at which time the normally closed contact C1-1 at rung R-176 of the counter C1 at rung R-179 opens to deenergize the coil M10 at rung R-176. This prevents any further rotation or indexing of the turntable 101 (see FIG. 1C) because the normally open contact M10-1 (see FIG. 18) at rung R-137 opens since the coil M10 at rung R-176 is deenergized.

Each time that the manual push button is activated manually to rotate or index the turntable 101 (see FIG. 1C), a normally open contact X15-4 (see FIG. 19) at rung R-183 is closed. This resets the count in the counter C1 at rung R-179 to 0. The counter C1 is an internal counter in the Mitsubishi programmable controller FX-32MR.

Likewise, a normally open contact X16-3 at rung R-183 is closed when the upper proximity switch 131 (see FIG. 4) senses the presence of the vertical surface 133 of the plate 95. This is when the stepper motor 85 has moved the lift arm 96 to its uppermost position. When this occurs, the counter C1 (see FIG. 19) at rung R-183 also is reset to 0.

As previously mentioned, the timer T8 at rung R-187 is turned on for 2.3 seconds when the normally open contact M6-2 of the coil M6 (see FIG. 18) at rung R-161 is closed and the normally closed contact X15-2 (see FIG. 19) at rung R-187 remains closed. When the coil M6 (see FIG. 18) at rung R-161 is energized, its normally open contact M6-2 at rung R-187 is closed to turn on the timer T8. The lift arm 96 (see FIG. 4) is then rotated by the rotary pneumatic actuator 97 from its home position to a position in which it will not block rotation or indexing of the turntable 101 (see FIG. 1C).

Rotation of the lift arm 96 occurs when the lower proximity switch 135 (see FIG. 4) senses the lift arm 96 is at its lowermost position to close a normally open contact X17-4 (see FIG. 19) at rung R-192 while a normally closed contact M29-5 at rung R-192 of the coil M29 at rung R-195 remains closed because of the coil M29 not being energized. The lift arm 96 (see FIG. 4) can only be rotated when it is at its lowermost position.

Accordingly, when a coil Y5 (see FIG. 19) at rung R-192 is energized, the lift arm 96 (see FIG. 1C) is rotated by the rotary pneumatic actuator 97. Because the timer T10 (see FIG. 19) at rung R-204 is activated for only 0.5 second, this is the length of time that the coil Y5 at rung R-192 is energized to activate the rotary pneumatic actuator 97 (see FIG. 1C) since the normally closed contact M29-5 (see FIG. 19) at rung R-192 is opened when the timer T10 at rung R-204 is turned off. When the timer T10 opens, its normally closed contact T10-2 at rung R-195 opens to deenergize the coil M29.

When the coil Y5 at rung R-192 is deenergized, the rotary pneumatic actuator 97 (see FIG. 4) has its direction reversed. This returns the lift arm 96 to its home position.

When the coil M29 (see FIG. 19) at rung R-195 is energized as previously discussed, its normally open contact M29-6 at rung R-213 closes to turn on a timer T11 for 0.8 second. This is 0.3 second greater than the length of time that the timer T10 at rung R-204 is turned on. Accordingly, since the timers T10 and T11 at rung R-213 are turned on at the same time, the timer T11 turns off 0.3 second after the coil M29 at rung R-195 is deenergized by the timer T10 at rung R-204 having turned off.

When the timer T11 at rung R-213 turns off, each of its normally open contact T11-1 at rung R-217 and its normally open contact T11-2 at rung R-220 closes. Closing of the contact T11-1 at rung R-217 pulses a coil M11 to energize it. Energization of the coil M11 closes its normally open contact M11-1 at rung R-209 to energize a coil Y14 since a normally closed contact T12-1 of a timer T12 (see FIG. 20) at rung R-229 remains closed. Energization of the coil Y14 (see FIG. 19) at rung R-209 causes its normally open contact Y14-1 to close. The closed contact Y14-1 latches the coil Y14 in its energized state.

When the stepper motor 85 (see FIG. 4) is activated by a coil Y-16 (see FIG. 20) at rung R-240 being energized, energization of the coil Y14 (see FIG. 19) at rung R-209 causes rotation of the stepper motor 85 (see FIG. 4) in a direction to move the lift arm 96 (see FIG. 1C) upwardly. Deenergization of the coil Y-14 (see FIG. 19) at rung R-209 results in downward movement of the lift arm 96 (see FIG. 1C).

Closing of the normally open contact T11-2 (see FIG. 19) at rung R-220 when the timer T11 at rung R-213 turns off after being on for 0.8 second causes a timer T13 at rung R-220 to be turned on for one second provided that the lift arm 96 (see FIG. 4) is in its lowermost position whereby a normally open contact X17-5 (see FIG. 19) at rung R-220 is closed. After the timer T13 is on for one second, it turns off and closes its normally open contact T13-1 (see FIG. 20) at rung R-240. Since both a normally closed contact M14-1 of a coil M14 at rung R-256 and a normally closed contact M17-1 at rung R-240 of a coil M17 at rung R-271 are closed, closing of the normally open contact T13-1 at rung R-240 energizes the coil Y16.

Energization of the coil Y16 energizes the stepper motor 85 (see FIG. 4) to rotate the lead screw 86 to move the lift arm 96 up since the coil Y14 (see FIG. 19) at rung R-209 is energized. The normally open contact T13-1 (see FIG. 20) at rung R-240 is closed for only a short period of time because the timer T13 (see FIG. 19) at rung R-220 is returned to its initial condition as soon as the stepper motor 85 (see FIG. 4) raises the lift arm 96 away from its lowermost position; this returns the normally open contact X17-5 (see FIG. 19) at rung R-220 to its open condition.

With the stepper motor 85 (see FIG. 4) activated by the coil Y16 (see FIG. 20) at rung R-240 being energized, the lift arm 96 (see FIG. 4) is raised upwardly to dispose the uppermost of the CDs 11 (see FIG. 1C) in the stack 100 on the spindle 102 at the supply position to the position at which the sensor 103 senses its presence. When this occurs, a normally closed contact X4-1 (see FIG. 20) at rung R-240 is opened to deenergize the coil Y16 to stop the stepper motor 85 (see FIG. 4).

As soon as the CD 11 (see FIG. 1C) at the top of the stack 100 is removed from the stack 100 by the pick-up arm 116 for insertion into one of the sleeves 12, the sensor 103 returns to the condition in which it sends a signal that it is not sensing one of the CDs 11; this returns the contact X4-1 (see FIG. 20) at rung R-240 to its normally closed position. This again causes the coil Y16 to be energized to activate the stepper motor 85 (see FIG. 2) to move the lift arm 96 upwardly until the uppermost of the CDs 11 in the stack 100 on the spindle 102 at the supply position is sensed by the sensor 103 (see FIG. 1C).

When the last of the CDs 11 in the stack 100 on the spindle 102 at the supply position is removed by the pick-up arm 116, the normally closed contact X4-1 (see FIG. 20) at rung R-240 returns to this state to keep the coil Y16 energized until the upper proximity switch 131 (see FIG. 4) senses that the lift arm 96 is at its uppermost position. When this occurs, a normally open contact X16-4 (see FIG. 20) at rung R-256 closes to pulse a coil M14. Energization of the coil M14 opens its normally closed contact M14-1 at rung R-240 to deenergize the coil Y16. This stops upward motion of the lift arm 96 (see FIG. 1C) at its uppermost position.

With the coil Y14 (see FIG. 19) at rung R-209 energized to cause upward movement of the lift arm 96 (see FIG. 1C) when the stepper motor 85 is activated to rotate the lead screw 86, a normally open contact Y14-2 (see FIG. 19) at rung R-225 is closed. As previously mentioned, the coil Y14 at rung R-209 is energized when the stepper motor 85 (see FIG. 4) is to move the lift arm 96 upwardly.

With the normally open contact Y14-2 (see FIG. 19) at rung R-225 closed and the normally closed contact X17-6 also closed because the lift arm 96 (see FIG. 1C) is not in its lowermost position, a coil M13 (see FIG. 19) at rung R-225 is energized. When the coil M13 is energized, its normally open contact M13-1 closes to latch the coil M13 in its energized position through the normally closed contact X17-6.

Energization of the coil M13 also closes its normally open contact M13-2 (see FIG. 20) at rung R-229. When the upper proximity switch 131 (see FIG. 4) senses that the lift arm 96 is in its uppermost position, a contact X16-5 (see FIG. 20) closes to turn on a timer T12 for 0.2 second. Thus, the coil Y14 (see FIG. 19) at rung R-209 is not deenergized until 0.2 second after the upper proximity switch 131 (see FIG. 4) has sensed the lift arm 96 reaching its uppermost position. Therefore, the normally closed contact T12-1 (see FIG. 19) at rung R-209 opens 0.2 second after the upper proximity switch 131 (see FIG. 4) has sensed the lift arm 96 is at its uppermost position. Opening of the normally closed contact T12-1 (see FIG. 19) at rung R-209 deenergizes the coil Y14 to cause the stepper motor 85 (see FIG. 4) to rotate in the opposite direction to move the lift arm 96 downwardly.

When the timer T12 (see FIG. 20) at rung R-229 turns off, its normally open contact T12-2 at rung R-260 closes. Since the coil Y14 (see FIG. 19) at rung R-209 has already been deenergized, its normally closed contact Y14-3 (see FIG. 20) at rung R-260 returns to its closed condition. Closing of the contact T12-2 turns on a timer T18 for 0.5 second.

When the timer T18 turns off, its normally open contact T18-1 at rung R-240 closes to energize the coil Y16 because the normally closed contacts M14-1 and M17-1 are closed. Energization of the coil Y16 causes the stepper motor 85 (see FIG. 4) to be energized to move the lift arm 96 downwardly since the coil Y14 (see FIG. 19) at rung R-209 is deenergized. Because the timer T12 (see FIG. 20) at rung R-229 requires 0.2 second to time out after the lift arm 96 (see FIG. 4) reaches its uppermost position and the timer T18 (see FIG. 20) at rung R-260 requires 0.5 second to time out after the timer T12 (see FIG. 20) at rung R-229 times out, there is a total delay of 0.7 second between the lift arm 96 (see FIG. 4) reaching its uppermost position and the stepper motor 85 being activated by the coil Y-16 (see FIG. 20) at rung R-240 being energized to move the lift arm 96 (see FIG. 4) downwardly.

When the coil Y14 (see FIG. 19) at rung R-209 is deenergized, its normally closed contact Y14-4 (see FIG. 20) at rung R-252 returns to its normally closed condition to turn on a timer T17. The timer T17 turns off after 0.1 second to cause its normally open contact T17-1 at rung R-240 to turn on. When the coil Y16 is energized by the normally open contact T18-1 closing, its normally open contact Y16-1 closes. Thus, closing of the normally open contact T17-1 provides a hold circuit for the coil Y16 to remain energized.

When the upper proximity switch 131 (see FIG. 4) senses that the lift arm 96 is at its uppermost position, a normally open contact X16-6 (see FIG. 20) at rung R-265 is closed. When the timer T12 at rung R-229 turns off after being on 0.2 second, its normally open contact T12-3 at rung R-265 is closed. This energizes a coil M16 since a normally closed contact T15-1 of a timer T15 at rung R-275 remains in its closed state. Energization of the coil M16 at rung R-265 closes its normally open contact M16-1 to latch the coil M16 in its energized condition through the normally closed contact T15-1.

When the coil M16 is energized, each of its normally open contact M16-2 at rung R-271 and its normally open contact M16-3 at rung R-275 is closed. Closing of the normally open contact M16-2 at rung R-271 pulses a coil M17 since a normally open contact X17-6 is closed by the lower proximity switch 135 (see FIG. 4) sensing that the lift arm 96 is in its lowermost position.

Energization of the coil M17 (see FIG. 20) at rung R-271 opens its normally closed contact M17-1 at rung R-240 to deenergize the coil Y16. This inactivates the stepper motor 85 (see FIG. 4).

When the lower proximity switch 135 senses that the lift arm 96 is at its lowermost position, a normally open contact X17-8 (see FIG. 20) at rung R-275 closes to turn on the timer T-15 for 0.2 second. When the timer T15 times out, its normally closed contact T15-1 at rung R-265 opens to deenergize the coil M16.

If it is desired to manually rotate or index the turntable 101 (see FIG. 1C), manual activation of a start push button not only closes the normally open contact X15-1 (see FIG. 18) at rung R-137 but also closes a normally open contact X15-5 (see FIG. 20) at rung R-235. If the lift arm 96 (see FIG. 1C) is not at its lowermost position (This is the only position at which the turntable 101 can be rotated.), a normally closed contact X17-9 (see FIG. 20) at rung R-235 remains closed. A normally closed contact T18-2 of a timer T18 at rung R-260 also is closed so that a coil M20 at rung R-235 is energized.

The timer T18 at rung R-260 is turned off 0.5 second after the normally open contact T12-2 is closed by the timer T12 at rung R-229 turning off after the timer T12 has been turned on for 0.2 second. The timer T12 can only be turned on when the lift arm 96 (see FIG. 4) has reached its uppermost position. When this occurs, the normally open contact X16-5 (see FIG. 20) at rung R-229 is closed by the upper proximity switch 131 (see FIG. 4) sensing the uppermost position of the lift arm 96. As previously mentioned, closing of the normally open contact X15-5 (see FIG. 20) at rung R-235 causes the coil M20 to be energized. Energization of the coil M20 closes its normally open contact M20-1 to latch the coil M20 in its energized state.

Energization of the coil M20 also closes its normally open contact M20-2 at rung R-229 to turn on the timer T12 for 0.2 second. When the timer T12 times out, its normally closed contact T12-1 (see FIG. 19) at rung R-209 opens to deenergize the coil Y14. Deenergization of the coil Y14 turns on the timer T17 (see FIG. 20) at rung R-252 for 0.1 second because deenergization of the coil Y14 (see FIG. 19) at rung R-209 causes its normally closed contact Y14-4 (see FIG. 20) at rung R-252 to close. Deenergization of the coil Y14 (see FIG. 19) at rung R-209 also causes the stepper motor 85 (see FIG. 4) to rotate in a direction to move the lift arm 96 downwardly when the stepper motor 85 is activated.

A normally open contact M20-3 (see FIG. 20) at rung R-256 is closed when the coil M20 at rung R-235 is energized. The coil M14 at rung R-256 is pulsed on when the normally open contact M20-3 of the coil M20 at rung R-235 closes. This electrically signals to the circuitry that the lift arm 96 (see FIG. 1C) has reached its uppermost position when it has not.

Energization of the coil M14 (see FIG. 20) at rung R-256 opens its normally closed contact M14-1 at rung R-240 to deenergize the coil Y16. This inactivates the stepper motor 85 (see FIG. 4).

Energization of the coil M20 (see FIG. 20) at rung R-235 closes its normally open contact M20-4 at rung R-265. When the timer T12 at rung R-229 turns off after being on 0.2 second, the normally open contact T12-3 at rung R-265 closes to energize the coil M16. The coil M16 is latched in its energized condition by closing of its normally open contact M16-1 since the normally closed contact T15-1 of the timer T15 at rung R-275 is closed.

The normally open contact T12-2 at rung R-260 closes when the timer T12 at rung R-229 times out after 0.2 second. Closing of the normally open contact T12-2 at rung R-260 turns on a timer T18 for 0.5 second. When the timer T18 turns off, its normally open contact T18-1 at rung R-240 closes.

Pulsing of the coil M14 at rung R-256 is only for a very short time period such as one millisecond, for example. This is substantially less than the minimum time that any timer is turned on. All of the pulses are on for the same very short period of time.

Accordingly, when the timer T18 at rung R-260 times out after being on for 0.5 second, its normally open contact T18-1 at rung R-240 closes to energize the coil Y16. The normally closed contact M14-1 of the coil M14 at rung 256 was opened for a very short period (one millisecond, for example) of time by pulsing of the coil M14 and then closed before either the normally open contact T17-1 at rung R-240 or the normally open contact T18-1 is closed.

Energization of the coil Y16 by the normally open contact T18-1 closing when the timer T18 at rung R-260 turns off causes energization of the stepper motor 85 (see FIG. 4). Because the coil Y14 (see FIG. 19) at rung R-209 has been deenergized by the normally closed contact T12-1, opening, rotation of the stepper motor 85 (see FIG. 4) is in a downward direction. Thus, the stepper motor 85 rotates the lead screw 86 to move the lift arm 96 downwardly.

Energization of the coil M20 (see FIG. 20) at rung R-235 causes its normally closed contact M20-5 at rung R-240 to open. Thus, if one of the CDs 11 (see FIG. 1C) is sensed by the sensor 103, the opening of the normally closed contact X4-1 (see FIG. 20) at rung R-240 will have no effect on deenergizing the coil Y16. A normally open contact Y14-5 of the coil Y14 (see FIG. 19) at rung R-209 also is open since it is energized only when upward motion of the lift arm 96 (see FIG. 4) is desired.

When the stepper motor 85 lowers the lift arm 96, the lower proximity switch 135 senses the lift arm 96 reaching its lowermost position and causes the normally open contact X17-1 (see FIG. 18) at rung R-137 to close whereby the coil Y4 is energized to cause the turntable 101 (see FIG. 1C) to be rotated or indexed by the rotary pneumatic actuator 97. This necessitates that the user hold the push button closed until the turntable 101 rotates.

The sensing by the lower proximity switch 135 (see FIG. 4) of the lift arm 96 being in its lowermost position also causes the normally open contact X17-7 (see FIG. 20) at rung R-271 to close. Since the coil M16 at rung R-265 is energized, its normally open contact M16-2 at rung R-271 is closed so that the coil M17 is pulsed on for a relatively short period of time.

When the coil M17 is energized, the normally closed contact M17-1 at rung R-240 opens to deenergize the coil Y16. This stops the stepper motor 85 (see FIG. 4).

When the normally open contact X17-8 (see FIG. 20) at rung R-275 closes, the timer T15 is turned on for 0.2 second since the normally open contact M16-3 of the coil M16 is closed because the coil M16 at rung R-265 is energized. When the timer T15 at rung R-275 turns off, its normally closed contact T15-1 at rung R-265 opens to deenergize the coil M16.

When it is desired to manually stop the apparatus 10 (see FIG. 1A), a stop push button 207 (see FIG. 22) is manually opened to cause a normally open contact X1-1 (see FIG. 16) at rung R-34 to close. Since a normally closed contact X0-3 is closed because it opens only when the manual push button 199 (see FIG. 22) is closed to start operation of the apparatus 10 (see FIG. 1A), a coil M5 (see FIG. 16) at rung R-34 is energized. Energization of the coil M5 closes its normally open contact M5-1 to latch the coil M5 energized through the normally closed contact X0-3.

Energization of the coil M5 causes its normally open contact M5-2 (see FIG. 15) at rung R-19 to close. This energizes the coil M27. Energization of the coil M27 opens its normally closed contact M27-1 at rung R-0 to deenergize the coil M0.

Deenergization of the coil M0 opens its normally open contact M0-2 (see FIG. 16) at rung R-49 and closes its normally closed contact M0-3 at rung R-45. Closing of the normally closed contact M0-3 turns on a timer T20 for 0.1 second. When the timer T20 turns off, its normally closed contact T20-1 at rung R-49 opens to open the hold circuit for the coil Y3 to deenergize the coil Y3. Since the normally open contact M0-2 opened 0.1 second earlier when the stop push button 207 (see FIG. 22) was activated, the coil Y3 (see FIG. 16) at rung R-49 is deenergized to stop the gear motor 66 (see FIG. 1A). Thus, stopping of the gear motor 66 is delayed by 0.1 second from when the stop push button 207 (see FIG. 22) was activated.

The gear motor 66 (see FIG. 1A) also is stopped when a normally open contact M4-1 (see FIG. 15) at rung R-19 is closed by energization of a coil M4 at rung R-24. The coil M4 is energized when the sensor 155 (see FIG. 12) remains turned on because it continues to sense one of the sleeves 12 (see FIG. 1B) without interruption to indicate that the sleeve 12 is prevented from moving. As a result, a normally open contact X11-6 (see FIG. 15) at rung R-29 remains closed.

A normally open contact Y20-1 is closed when a coil Y20 (see FIG. 16) at rung R-42 is energized. The coil Y20 is energized when a normally open contact M0-6 of the coil M0 (see FIG. 15) at rung R-0 is energized; this is when the conveyor belt 19 (see FIG. 1A) is being advanced by the gear motor 66.

A normally closed contact T23-1 (see FIG. 16) at rung R-42 remains closed as long as the sensor 103 (see FIG. 1C) is cycling because of one of the CDs 11 being raised by the lift arm 96 to the pick-up position at which the CD 11 is picked up by the pick-up arm 116. Cycling of the sensor 103 off and on causes a normally open contact X4-2 (see FIG. 16) at rung R-38 to start and stop a timer T23. The timer T23 does not open its normally closed contact T23-1 at rung R-42 unless the timer T23 is turned on for 3 seconds. This does not happen as long as one of the CDs 11 is at the pick-up position to be sensed by the sensor 103 (see FIG. 1C).

Accordingly, cycling of the sensor 103 shows that the CDs 11 are available for pick up by the pick-up arm 116 and insertion into the sleeves 12 while the normally open contact X11-6 (see FIG. 15) at rung R-29 remaining closed shows that the sleeves 12 (see FIG. 1B) are not advancing past the sensor 155(see FIG. 12). Therefore, there is a jam up of the sleeves 12 (see FIG. 1B).

Therefore, with the normally open contact X11-6 (see FIG. 15) at rung R-29 remaining closed rather than cycling as the sleeves 12 (see FIG. 1B) pass the sensor 155 (see FIG. 12), a timer T6 (see FIG. 15) at rung R-29 remains turned on for three seconds. When the timer T6 turns off after three seconds, its normally open contact T6-1 at rung R-24 closes. With the manual start push button 199 (see FIG. 22) not activated, a normally closed contact X0-4 (see FIG. 15) at rung R-24 remains closed. Accordingly, the coil M4 is energized to close its normally open contact M4-1 at rung R-19 to stop the gear motor 66 (see FIG. 1A).

The coil M4 (see FIG. 15) at rung R-24 is latched in its energized state by its normally open contact M4-2 being closed when the coil M4 is energized. It should be understood that a normally closed contact M11-2 remains in this state except when a coil M11 (see FIG. 19) at rung R-217 is pulsed. This occurs only when the lift arm 96 (see FIG. 4) is to be raised.

When the lift arm 96 reaches its uppermost position so that it is sensed by the upper proximity switch 131, a normally open contact X16-7 (see FIG. 16) at rung R-53 is closed. This energizes a coil Y21 to stop the stepper motor 108 (see FIG. 9) from rotating the pick-up arm 116 since one of the CDs 11 is not at the pick-up position. Energization of the coil Y21 (see FIG. 16) at rung R-53 changes the state of a contact (not shown) to stop the flow of power to the stepper motor 108 (see FIG. 9).

The coil Y21 (see FIG. 16) at rung R-53 is deenergized by the normally open contact X16-7 opening when the upper proximity switch 131 (see FIG. 4) is no longer sensing the lift arm 96. This allows power to again be supplied to the stepper motor 108.

After the lift arm 96 has been moved up from its lowermost position and returned to its lowermost position, the timer T10 (see FIG. 19) at rung R-204 is turned on for 0.5 second. When the timer T10 turns off after 0.5 second, its normally open contact T10-3 (see FIG. 15) at rung R-7 is closed. With the coil M0 at rung R-0 deenergized at this time, its normally closed contact M0-9 at rung R-7 remains closed to energize a coil M25 since the normally open contact T10-3 is closed.

Energization of the coil M25 closes its normally open contact M25-1 to latch the coil M25 in its energized state as long as the coil M0 at rung R-0 is not energized. The coil M0 is energized when the gear motor 66 (see FIG. 1A) is again started.

Energization of the coil M25 (see FIG. 15) at rung R-7 also closes its normally open contact M25-2 at rung R-11. With the coil M0 deenergized, its normally closed contact M0-10 remains closed. A normally open contact X4-3 closes only when the sensor 103 (see FIG. 1C) senses that one of the CDs 11 is at the pick-up position of the pick-up arm 116. Therefore, the coil M23 (see FIG. 15) at rung R-11 can only be energized when the normally open contact X4-3 closes to indicate that another of the stacks 100 (see FIG. 1C) of the CDs 11 on one of the spindles 102 is at the supply position.

Energization of the coil M23 (see FIG. 15) at rung R-11 closes its normally open contact M23-1. This latches the coil M23 in its energized state.

Energization of the coil M23 also closes its normally open contact M23-2 at rung R-16. This provides a pulse to a coil M24.

Energization of the coil M24 causes its normally open contact M24-1 at rung R-0 to close. This energizes the coil M0 to again start the gear motor 66 (see FIG. 1A). Therefore, pulsing of the coil M24 (see FIG. 15) at rung R-16 restarts the gear motor 66 (see FIG. 1A).

When the sensor 83 (see FIG. 12) senses the presence of one of the sleeves 12 (see FIG. 1C), the signal from the sensor 83 (see FIG. 12) is sent to the software of the Compumotor SXF Indexer/Driver. This signal not only activates the stepper motor 108 (see FIG. 9) but also closes normally open contacts X20-1 (see FIG. 16) at rung R-78 and X21-5 (see FIG. 17) at rung R-80 upon receipt of the signal.

Closing of the normally open contact X21-5 energizes a coil Y11 of a solenoid. Energization of the coil Y11 shifts a valve to reverse the direction of flow of pressurized air to the air cylinder (not shown) within the pick-up slide 118 (see FIG. 9). This moves the pick-up block 121 downwardly to pick up the uppermost of the CDs 11 in the stack 100 at the supply position.

Closing of the normally open contact X20-1 (see FIG. 16) at rung R-78 energizes a coil Y10 of a solenoid. This shifts a valve to apply a vacuum to the arcuate groove 125 (see FIG. 11) in the pick-up block 121 to hold the CD 11 (see FIG. 1C) on the pick-up block 121.

The encoder 46 (see FIG. 1D) continuously supplies the speed of the gear motor 66 (see FIG. 1A) to the software of the Compumotor SXF Indexer/Driver. This enables the software to change the speed of the stepper motor 108 (see FIG. 9) in accordance with the speed of the conveyor belt 19 (see FIG. 1C). This insures that the pivotally mounted arm 116, which is driven by the stepper motor 108 (see FIG. 9), is always moving at the same linear speed as the conveyor belt 19 (see FIG. 1C) when the CD 11 is inserted into the sleeve 12 by the pivotally mounted pick-up arm 116.

According to the *Programming Manual*, effective March 1987, for Mitsubishi Programmable Controller MEL-SEC F1 series, the X coils are described as input relays, the Y coils as output relays, and the M coils as auxiliary relays. The timers and counters are internal elements of the programmable controller.

Figure 2:
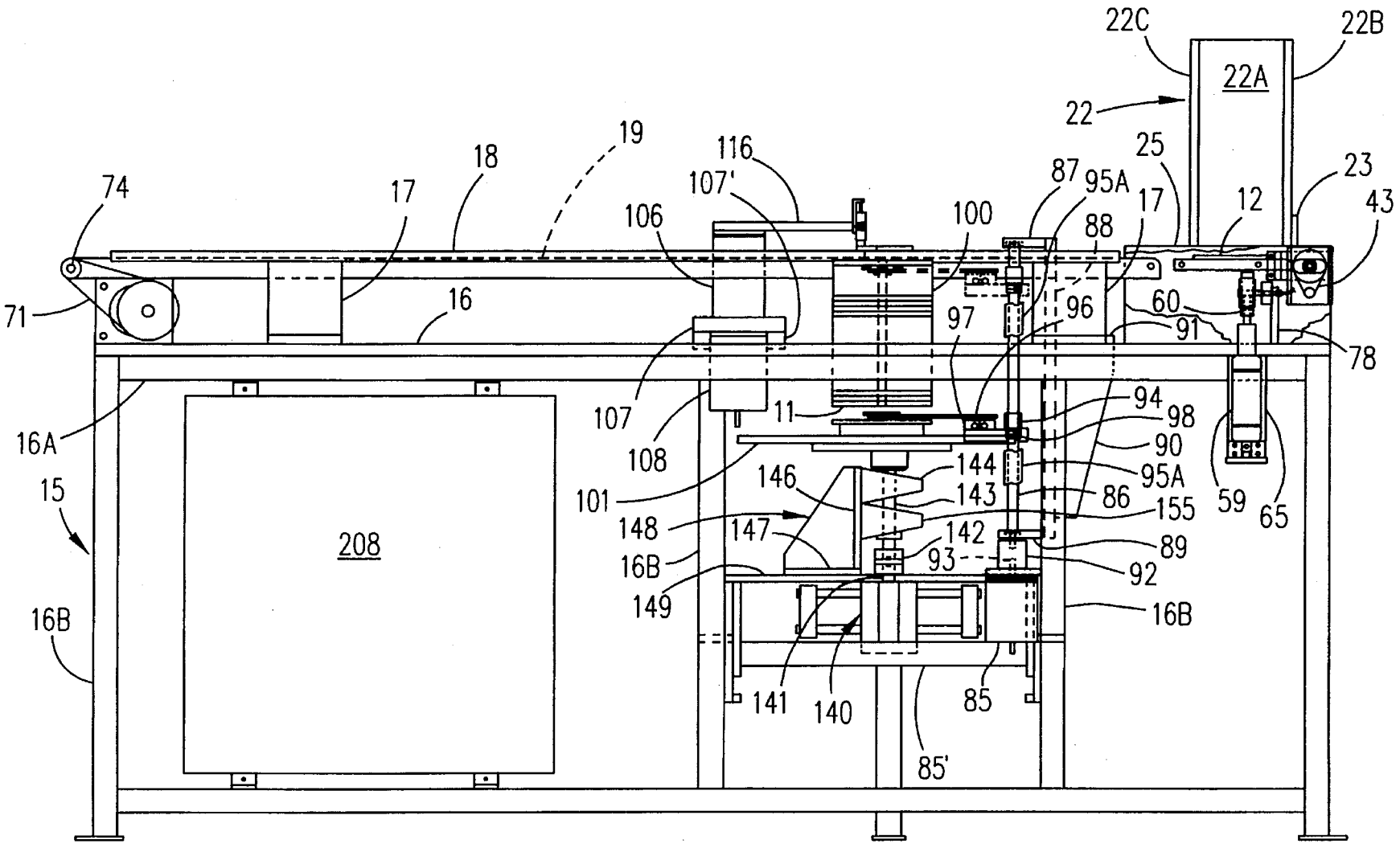
FIG. 2 is a side elevational view of the insert apparatus of FIGS. 1A–1D and taken along line 2—2 of FIGS. 1A–1D.

All of the electrical controls including the software are disposed within two boxes (one shown at 208 in FIG. 2). Each of the two boxes (one shown at 208 in FIG. 2) is supported by two of the vertical square tubes 16B of the support frame 15 extending between two of the horizontal square tubes 16A.

An advantage of this invention is that it enables the feed rate of the containers to be selectively changed to permit containers to be fed to another conveyor, which must be driven at a specified feed rate of a device, such as a labeling machine, for example. Another advantage of this invention is that sleeves are fed at a relatively high rate.

For purposes of exemplification, a particular embodiment of the invention has been shown and described according to the best present understanding thereof, However, it will be apparent that changes and modifications in the arrangement and construction of the parts thereof may be resorted to without departing from the spirit and scope of the invention.

We claim:

1. An apparatus for inserting an element into a container having at least one edge open including:

continuously linear advancing means for continuously advancing a container having at least one edge open from a first position to a second position in a linear direction to enable an element to be inserted into the container;

maintaining means for maintaining the container in a desired orientation during its linear advancement by said continuously linear advancing means;

inserting means for inserting an element into the container during linear advancement of the container by said continuously linear advancing means at a first intermediate position between the first and second positions;

and holding means for holding the at least one open edge of the container sufficiently open when said inserting means is effective to enable the container to receive the element inserted therein by said inserting means.

2. The apparatus according to claim 1 in which said inserting means includes:

moving means for moving the element from a pick-up position partially into the container through the edge of the container held open by said holding means;

and completing means for completing insertion of the element into the container after said continuously linear advancing means has advanced the container beyond the first intermediate position and prior to the second position.

3. The apparatus according to claim 2 in which said completing means includes:

first moving means for moving the element further into the container after the container has been advanced by said continuously linear advancing means from the first intermediate position to a second intermediate position between the first intermediate position and the second position;

and second moving means for moving the element completely into the container after the container has been advanced by said continuously linear advancing means from the second intermediate position to a third intermediate position between the second intermediate position and the second position.

4. The apparatus according to claim 3 in which each of said first moving means and said second moving means of said completing means moves substantially perpendicular to movement of the container in the linear direction.

5. The apparatus according to claim 4 in which said holding means includes air pressure applying means for applying pressurized air to hold the at least one open edge of the container sufficiently open to receive the element.

6. The apparatus according to claim 5 including orienting means for orienting the container in the desired orientation during its entire movement in the linear direction by said continuously linear advancing means between at least the first intermediate position and the third intermediate position when the container has one of the elements inserted therein at the first intermediate position.

7. The apparatus according to claim 6 in which:

said continuously linear advancing means includes conveyor means;

and said maintaining means includes vacuum applying means for continuously applying a vacuum to the container on said conveyor means to maintain the container in the desired orientation.

8. The apparatus according to claim 7 including loading means for loading the container on said conveyor means at the first position.

9. The apparatus according to claim 8 in which said loading means includes:

a magazine having a plurality of the containers therein in a stacked relation;

removal means for removing the lowermost of the containers from said magazine;

and transport means for transporting the removed container to said conveyor means.

10. The apparatus according to claim 9 including control means for controlling when said removal means is effective.

11. The apparatus according to claim 3 including:

first sensing means for sensing when each of the containers is at the second intermediate position;

means responsive to said first sensing means sensing the presence of each of the containers at the second intermediate position to activate said first moving means of said completing means;

second sensing means for sensing when each of the containers is at the third intermediate position;

and means responsive to said second sensing means sensing the presence of each of the containers at the third intermediate position to activate said second moving means of said completing means.

12. The apparatus according to claim 1 including: said inserting means including:

a pivotally mounted arm movable between a home position and an element inserting position;

and pick-up means on said pivotally mounted arm for picking up and holding the element to be inserted;

and control means for controlling when said pivotally mounted arm is activated in accordance with when one of the containers is at a predetermined distance prior to the first intermediate position and one of the elements is at a pick-up position.

13. The apparatus according to claim 12 in which said control means includes element sensing means for sensing when one of the elements is at the pick-up position.

14. The apparatus according to claim 13 including:

positioning means for positioning a stack of a plurality of elements at a supply position;

said element sensing means sensing that the stack has at least one of the elements at the pick-up position;

and lifting means for lifting the stack of the elements at the supply position after the uppermost of the elements in the stack at the pick-up position has been picked up by said pivotally mounted arm to position the next of the elements in the stack at the pick-up position.

15. The apparatus according to claim 14 including means responsive to said element sensing means sensing none of the elements in the stack at the pick-up position for moving another of the stacks of the elements to the supply position.

16. The apparatus according to claim 15 including:

rotatable means for supporting a plurality of the stacks of the elements at equally angularly spaced distances from each other;

said responsive means including rotating means for simultaneously rotating all of the stacks of the elements a predetermined angular amount, equal to the angular distance between two adjacent of the stacks of the elements, each time that said element sensing means senses none of the elements in the stack at the pick-up position;

and preventing means for preventing said rotating means from being effective after said rotating means has been rotated a predetermined number of times.

17. The apparatus according to claim 12 in which said pick-up means includes means for applying a vacuum only to a selected area of the element to be picked up.

18. The apparatus according to claim 12 in which said pick-up means includes means for applying a vacuum to the element to be picked up.

19. The apparatus according to claim 12 in which:

said holding means includes air pressure applying means for applying pressurized air to the at least one open edge of the container to hold the at least one open edge of the container sufficiently open to receive the element;

and said pivotally mounted arm supports said air pressure applying means.

20. The apparatus according to claim 1 in which said holding means is supported by said inserting means.

21. The apparatus according to claim 4 including orienting means for orienting the container in the desired orientation during its entire movement in the linear direction by said continuously linear advancing means between at least the first intermediate position and the third intermediate position when the container has one of the elements inserted therein at the first intermediate position, said orienting means being separate from said maintaining means.

22. The apparatus according to claim 3 including orienting means for orienting the container in the desired orientation during its entire movement in the linear direction by said continuously linear advancing means between at least the first intermediate position and the third intermediate position when the container has one of the elements inserted therein at the first intermediate position, said orienting means being separate from said maintaining means.

23. The apparatus according to claim 1 in which said inserting means includes:

a pivotally mounted arm movable between a home position and an element inserting position;

and pick-up means on said pivotally mounted arm for picking up and holding the element to be inserted.

24. The apparatus according to claim 23 in which:

said holding means includes air pressure applying means for applying pressurized air to the at least one open edge of the container to hold the at least one open edge of the container sufficiently open to receive the element;

and said pivotally mounted arm supports said air pressure applying means.

25. The apparatus according to claim 1 in which:

said inserting means includes moving means movable between a home position and an element inserting position;

and said moving means supports said holding means.

26. The apparatus according to claim 25 in which said moving means includes pick-up means for picking up and holding the element to be inserted.

27. The apparatus according to claim 1 in which:

said continuously linear advancing means includes conveyor means;

and said maintaining means includes vacuum applying means for continuously applying a vacuum to the container on said conveyor means to maintain the container in the desired orientation.

28. The apparatus according to claim 1 in which said holding means includes air pressure applying means for applying pressurized air to hold the at least one open edge of the container sufficiently open to receive the element.

29. The apparatus according to claim 1 including control means for controlling when said inserting means is effective.

30. The apparatus according to claim 1 in which the at least one open edge of the container is a substantially horizontally disposed open edge to enable an element to be inserted therethrough into the container.

31. The apparatus according to claim 1 in which said inserting means includes moving means.

32. The apparatus according to claim 1 in which the element is a CD and the container is a sleeve slightly larger than the element.

33. The apparatus according to claim 1 in which said inserting means includes pick-up means for picking up and holding the element to be inserted.

34. The apparatus according to claim 1 in which the container is slightly larger than the element so that the element has a rather tight fit within the container when inserted therein.

35. The apparatus according to claim 1 in which said inserting means includes means for moving the element at substantially the same linear speed as the container when the element is inserted within the container.

36. The apparatus according to claim 1 including orienting means for orienting the container in the desired orientation during its entire movement in the linear direction by said continuously linear advancing means at least when said inserting means inserts one of the elements into the container, said orienting means being separate from said maintaining means.

37. An apparatus for inserting an element into a container having at least one edge open including:

continuously advancing means for continuously advancing a container having at least one edge open from a first position to a second position in a predetermined direction to enable an element to be inserted into the container;

maintaining means for maintaining the container in a desired orientation during its advancement by said continuously advancing means;

movable inserting means for inserting an element into the container through the at least one open edge of the container during advancement of the container by said continuously advancing means at a first intermediate position between the first and second positions;

and holding means for holding the at least one open edge of the container sufficiently open when said inserting means is effective to enable the container to receive the element inserted therein by said inserting means.

* * * * *

UNITED STATES PATENT AND TRADEMARK OFFICE

CERTIFICATE OF CORRECTION

PATENT NO. : 5,561,962

DATED : October 8, 1996

INVENTOR(S) : Paul P. Everhard et al

It is certified that error appears in the above-identified patent and that said Letters Patent is hereby corrected as shown below:

Column 5, line 61, "54C" should read -- 54-C --
Column 9, line 55, "pickup" should read -- pick-up --
Column 14, line 51, "while" should read -- While --
Column 19, line 36 should read -- 19) at rung R-107. --
Column 24, line 66 should read as follows:
-- most position of the lift arm 96.
As previously mentioned, --
Column 30, lines 34-45 should read as follows:
-- 12. The apparatus according to claim 1 including:
said inserting means including:
a pivotally mounted arm movable between a home position and an element inserting position;
and pick-up means on said pivotally mounted arm for picking up and holding the element to be inserted;
and control means for controlling when said pivotally mounted arm is activated in accordance with when one of the containers is at a predetermined distance prior to the first intermediate position and one of the elements is at a pick-up position. --

Signed and Sealed this

Twenty-fifth Day of February, 1997

Bruce Lehman

*Attest:*

BRUCE LEHMAN

*Attesting Officer*

*Commissioner of Patents and Trademarks*